US009380870B2

(12) United States Patent
Babick

(10) Patent No.: US 9,380,870 B2
(45) Date of Patent: Jul. 5, 2016

(54) TABLET ARM MECHANISM

(71) Applicant: DSA International, LLC, Zeeland, MI (US)

(72) Inventor: Tod Babick, Grand Rapids, MI (US)

(73) Assignee: DSA International, Inc., Zeeland, MI (US)

( * ) Notice: Subject to any disclaimer, the term of this patent is extended or adjusted under 35 U.S.C. 154(b) by 0 days.

(21) Appl. No.: 14/497,465

(22) Filed: Sep. 26, 2014

(65) Prior Publication Data

US 2016/0088938 A1 Mar. 31, 2016

(51) Int. Cl.

| | |
|---|---|
| ***A47B 41/00*** | (2006.01) |
| ***A47B 83/02*** | (2006.01) |
| ***A47C 7/62*** | (2006.01) |
| ***A47B 41/02*** | (2006.01) |

(52) U.S. Cl.

CPC ..... *A47B 83/02* (2013.01); *A47B 41/02* (2013.01); *A47C 7/62* (2013.01)

(58) Field of Classification Search

CPC ..... A47C 7/70; A47B 83/02; A47B 3/14; A47B 39/00; Y10T 16/5472; E05D 3/10; B60N 3/001; B64D 11/0638

USPC ..... 297/173, 162; 248/443, 447.1, 447.2, 248/291.1; 108/42, 50.14, 50.16, 134, 135

See application file for complete search history.

(56) References Cited

U.S. PATENT DOCUMENTS

| | | | | | |
|---|---|---|---|---|---|
| 1,093,686 | A * | 4/1914 | Cogger | A47C 7/70 | 297/162 |
| 3,547,488 | A * | 12/1970 | Barnes | A47C 7/70 | 297/154 |
| 3,596,442 | A * | 8/1971 | Neumann | B01D 46/02 | 55/354 |
| 4,203,624 | A * | 5/1980 | Hopkins | A47C 7/70 | 108/142 |
| 4,852,940 | A * | 8/1989 | Kanigowski | A47B 5/00 | 108/140 |
| 4,944,552 | A * | 7/1990 | Harris | A47C 7/70 | 297/145 |
| 5,087,096 | A * | 2/1992 | Yamazaki | A47C 7/70 | 297/145 |
| 5,490,710 | A * | 2/1996 | Dearing | A47C 7/70 | 248/118.5 |
| 6,073,997 | A * | 6/2000 | Koh | A47C 7/70 | 297/162 |
| 6,224,149 | B1 * | 5/2001 | Gevaert | A47C 7/70 | 297/160 |
| 6,375,257 | B1 * | 4/2002 | Wooding | A47C 7/70 | 248/218.4 |
| 2011/0101740 | A1 * | 5/2011 | Koh | A47C 7/70 | 297/162 |
| 2012/0306240 | A1 * | 12/2012 | van Hekken | A47C 7/70 | 297/160 |

FOREIGN PATENT DOCUMENTS

| | | |
|---|---|---|
| EP | 0395079 | * 10/1990 |

* cited by examiner

*Primary Examiner* — Janet M Wilkens

(74) *Attorney, Agent, or Firm* — Niro McAndrews, LLC

(57) ABSTRACT

Disclosed is a dual axis of rotation tablet arm storage mechanism. The mechanism includes a first rotor block rotationally secured to a second rotor block. Both rotor blocks travel within a dual walled track of the mechanism. In the use configuration, the walls of the track are adjacent to the second rotor and restrict the rotation of the second rotor to help stabilize the writing surface. While the disclosed tablet arm maintains the benefits of other tablet arm mechanisms, many other benefits are achieved such as a mechanism that is free of pinch points during operation. The disclosed mechanism includes a dual access rotation mechanism that also allows the elevational alignment of the tablet top surface to be adjusted while the table top is in use.

19 Claims, 33 Drawing Sheets

TABLET ARM MECHANISM

FIELD OF THE INVENTION

The present invention relates generally to multi-configuration table top surfaces and more particularly to storable tablet surfaces secured to chairs.

BACKGROUND OF THE INVENTION

Storable writing surfaces secured to furniture have been the subject of numerous patents, such as Chancey Sherman's 1867 Letters U.S. Pat. No. 68,659, however the mechanisms disclosed in these references typically have numerous pinch points that could injure a child who sticks their fingers into the mechanism as it is operated. As a result, storable desk tops attached to chairs are rarely used in the early school years.

SUMMARY OF THE INVENTION

The present invention provides an improved tablet arm rotation mechanism. While the present invention maintains the benefits of other tablet arm mechanisms, many other benefits are also achieved such as a mechanism that is free of pinch points during operation. The disclosed invention includes a dual axis rotation mechanism that also allows the elevational alignment of the tablet top surface to be adjusted while the table top is in use.

DETAILED DESCRIPTION

The present invention may be used with any planar surface that is secured to a post and rotated from a vertical storage configuration to a horizontal use configuration. However, for descriptive purposes, the present invention will be described as in use as a tablet arm mechanism attached to a chair.

Figure 1:
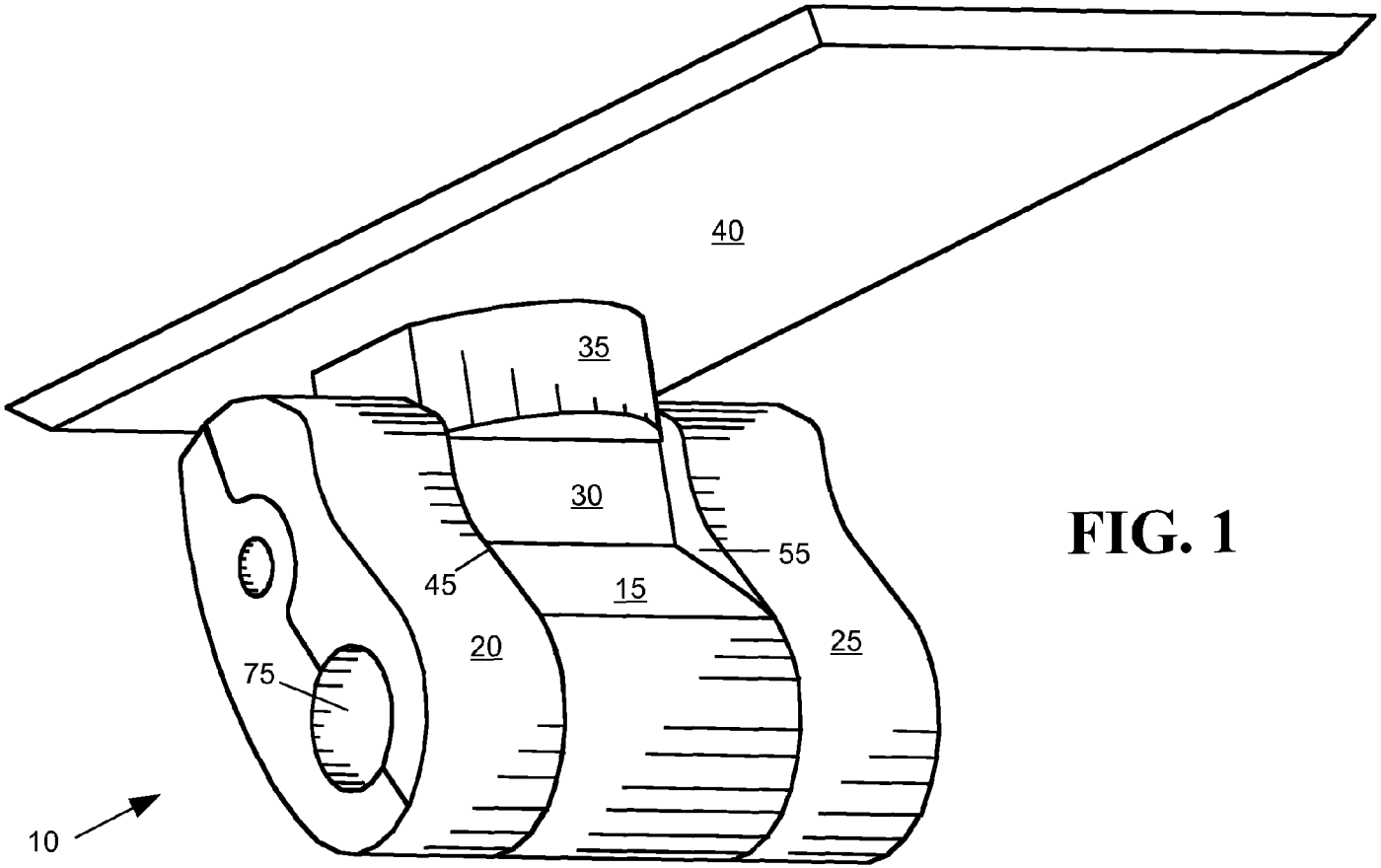
FIG. 1 is a lower perspective view of a tablet arm mechanism in a use configuration.

FIG. 1 shows a tablet arm mechanism 10 with a connector piece 15 extending between a first side piece 20 and a second side piece 25. The first side piece, the second side piece, and the connector piece form a base that can be secured to a seat. Rotationally secured between the first side piece 20 and the second side piece 25 is a first rotor block 30. Rotationally secured to the first rotor block 30 is a second rotor block 35 that rotates relative to the first rotor block 30. A tablet top may be secured directly to the second rotor block 35, or a tablet plate 40 or tablet connection plate may be secured onto the second rotor block 35 to better support the load of the table top.

Figure 2:
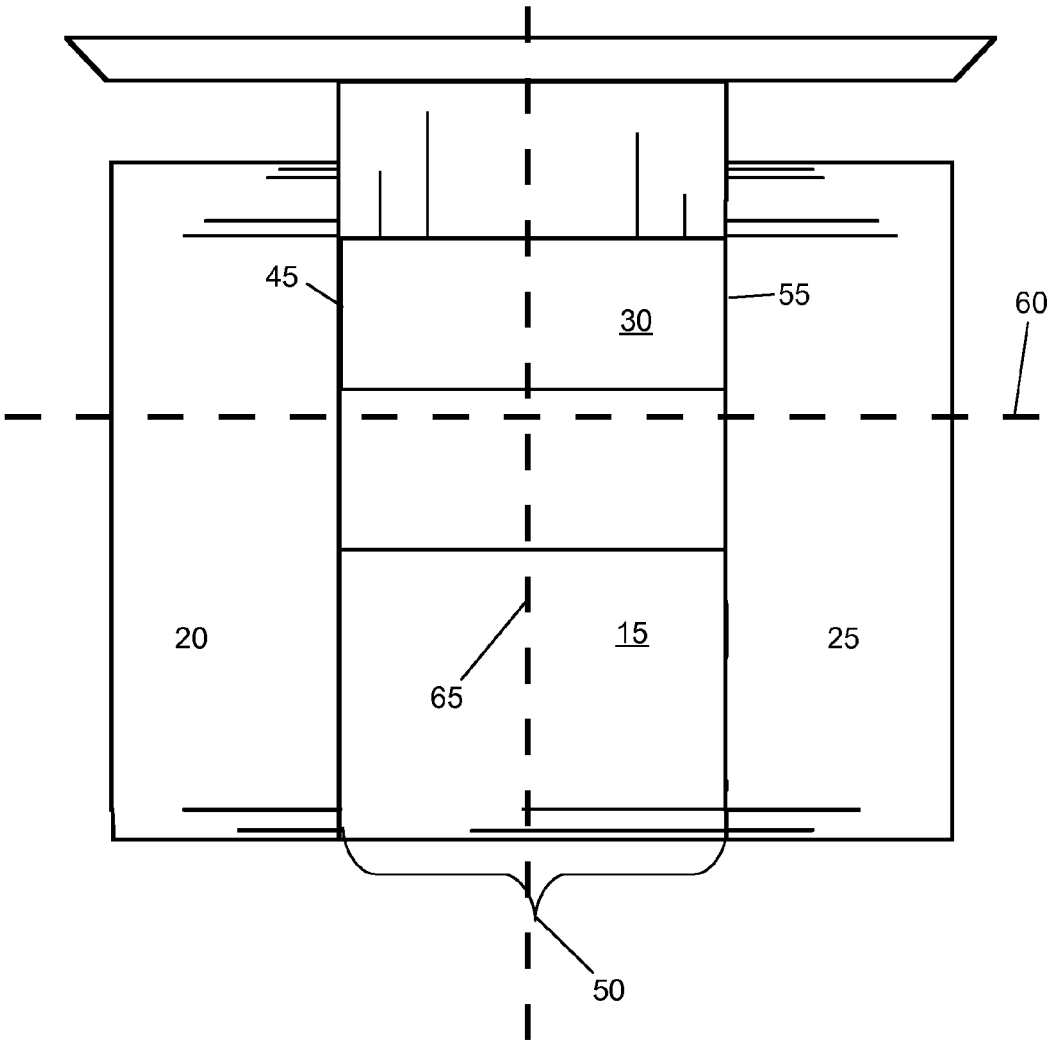
FIG. 2 is a side elevational view of the tablet arm mechanism in a use configuration.

The first side piece 20 includes a first wall 45 that is located a first distance 50 from a second wall 55 of the second side piece 25. As can be seen in FIG. 2, the widths of both the connector piece 15 and the first rotor block 30 are substantially equal to the separation of the first wall 45 from the second wall 55. While there may be minor gaps between the first rotor block 30 and the two walls (45, 55), it is expected that the tablet arm mechanism may be used in seating for young children and the gaps would be of insufficient size to allow children to put their fingers in the gaps.

The first rotor block 30 rotates about a first axis of rotation 60 that is substantially perpendicular to both the first wall 45 and the second wall 55. Each of the side pieces (20, 25) has an aperture (65, 70) that defines a channel 75 that extends parallel to the first axis of rotation 60. The channel 75 is configured to clamp around the arm of a chair as shown in FIGS. 3 through 6. Since it is generally expected that the tablet arm mechanism will be clamped onto a horizontal chair arm, it is also expected that rotation of the first rotor block 35 will cause the tablet plate 40 to vertically adjust.

As can be seen in FIG. 2, when the tablet arm mechanism is in a use configuration a portion of the second rotor block 35 is also directly located between both the first wall 45 and the second wall 55. Additionally, like the first rotor block 30, the second rotor block 35 has a width that is substantially equal to the first distance. The second rotor block 35 rotates about a second axis of rotation 65 relative to the first rotor block 30. The second axis of rotation 65 is perpendicular to the first axis of rotation 60, and in the illustrated example the first axis of rotation 60 is both always perpendicular and intersecting with the second axis of rotation 65. While the second axis of rotation 65 is stationary relative to the first rotor block 30, it should be appreciated that since the first rotor block 30 rotates relative to the chair, the second axis of rotation 65 moves with the first rotor block 30. This movement is highlighted in FIGS. 20 and 21.

Figure 3:
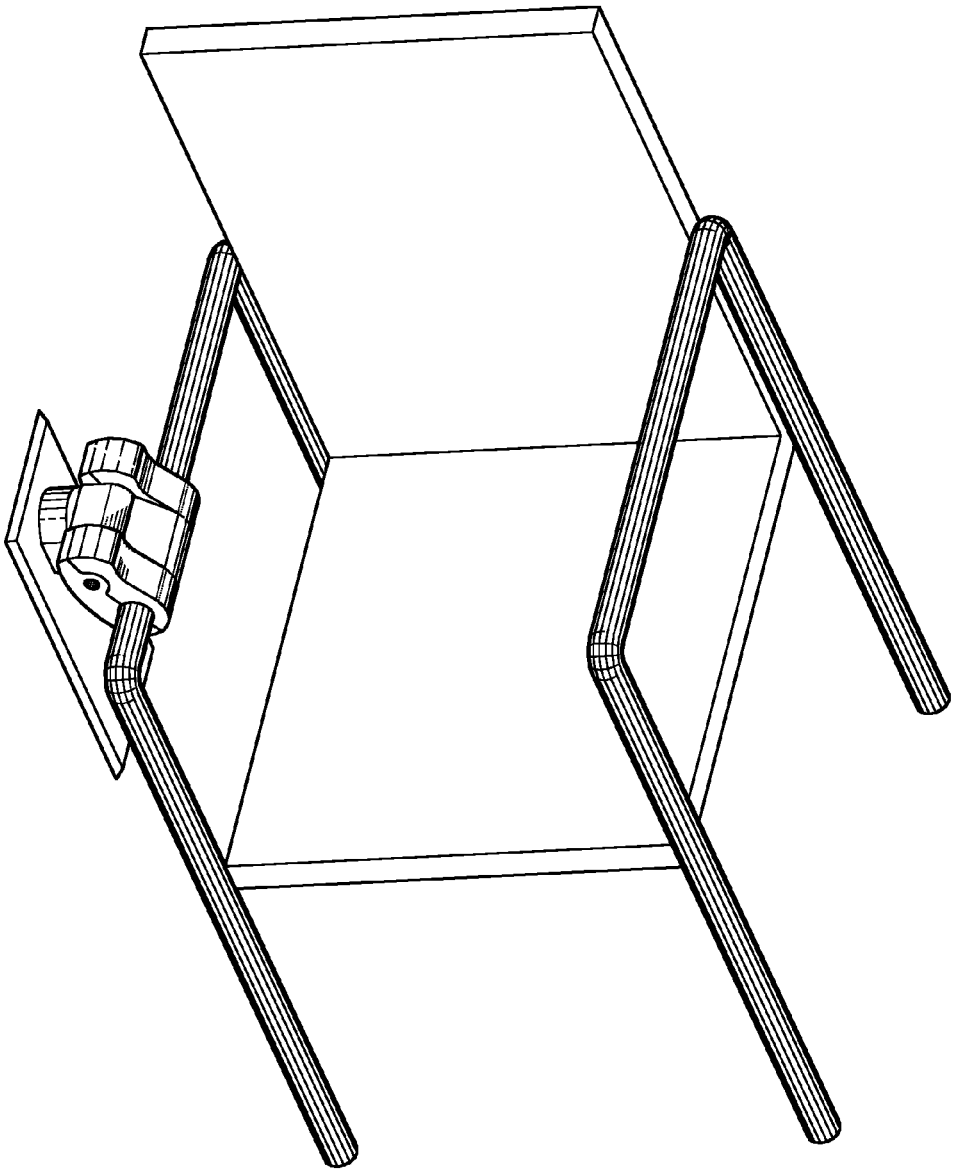
FIG. 3 is an upper perspective view of a tablet arm mechanism in a storage configuration attached to a chair.
Figure 4:
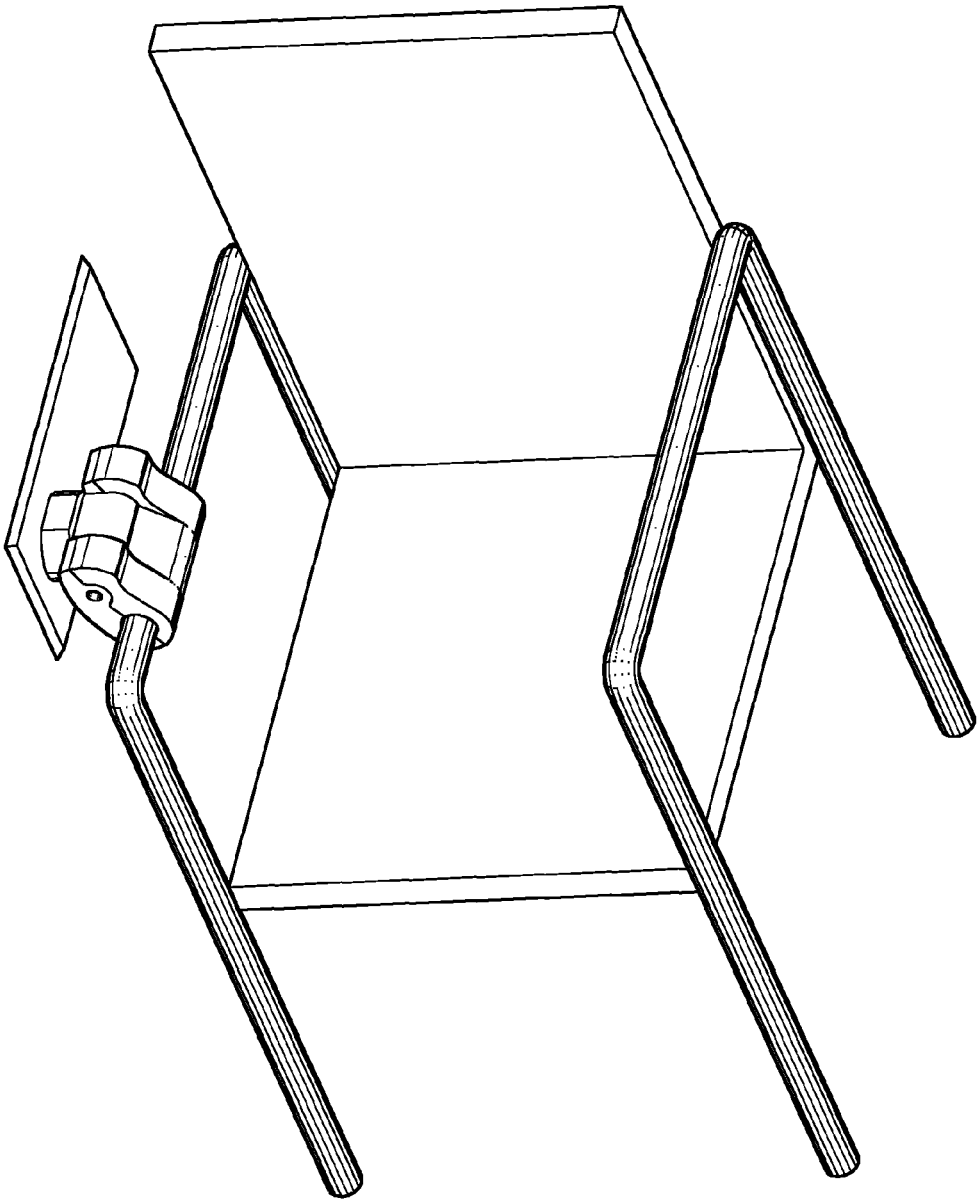
FIG. 4 is an upper perspective view of a tablet arm mechanism attached to a chair and in the first step of transitioning from a storage configuration to a use configuration.
Figure 5:
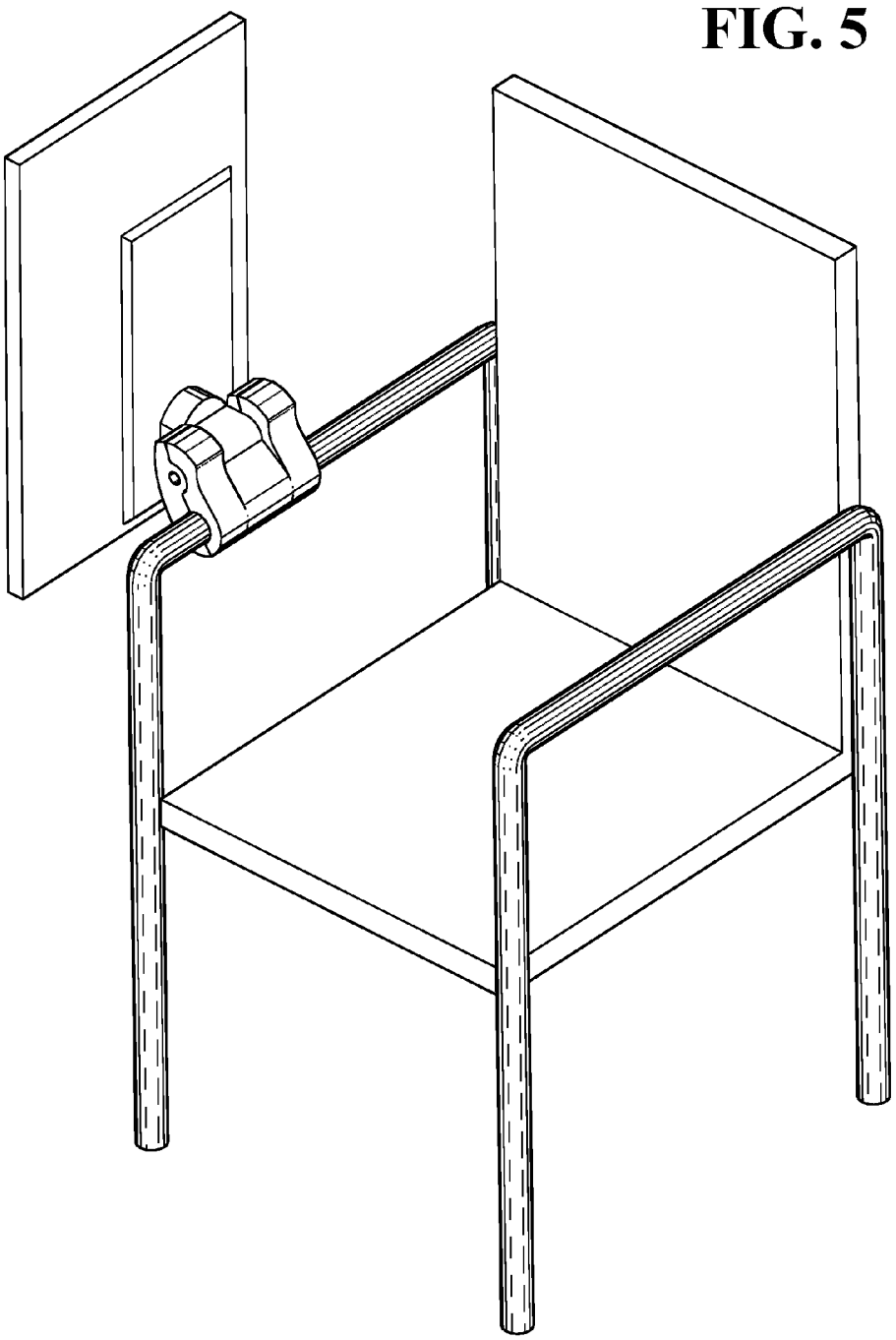
FIG. 5 is an upper perspective view of a tablet arm mechanism attached to a chair and in the second step of transitioning from a storage configuration to a use configuration.

FIGS. 3 through 6 illustrate how the first rotor block 30 and the second rotor block 35 operate in combination to move a table surface from a vertical storage configuration to a horizontally oriented use configuration. In FIG. 3, the tablet plate 40 is shown as substantially vertical with the distant end 80 located below the rotor end 85 of the tablet plate 40. Moving from FIG. 3 to FIG. 4, the second rotor block 35 is rotated until the distant end 80 and rotor end 85 of the tablet plate 40 are located at the same elevation. In FIG. 5, the second rotor block has rotated 180 degrees from the configuration shown in FIG. 3 and the distant end 85 is located directly above the rotor end 85. FIG. 5 also shows the tablet arm mechanism with an additional table top attached to the tablet plate. In the transition from the configuration shown in FIG. 3 to that of FIG. 5, the second rotor block 35 is rotating while the first rotor block 30 is substantially stationary. The first rotor block 30 may rotate a trivial amount, but the tablet plate 40 remains vertically oriented. Once the second rotor block 35 reaches the configuration shown in FIG. 5, the first rotor block 30 is allowed to rotate the tablet plate from the vertical orientation shown in FIG. 5 to the horizontal orientation shown in FIG. 6. The second rotor block has a second width that is greater than the first distance and acts to block the second rotor block from entering the track between the first wall and the second wall while the tablet arm mechanism is in the configuration shown in FIG. 4.

Figure 7:
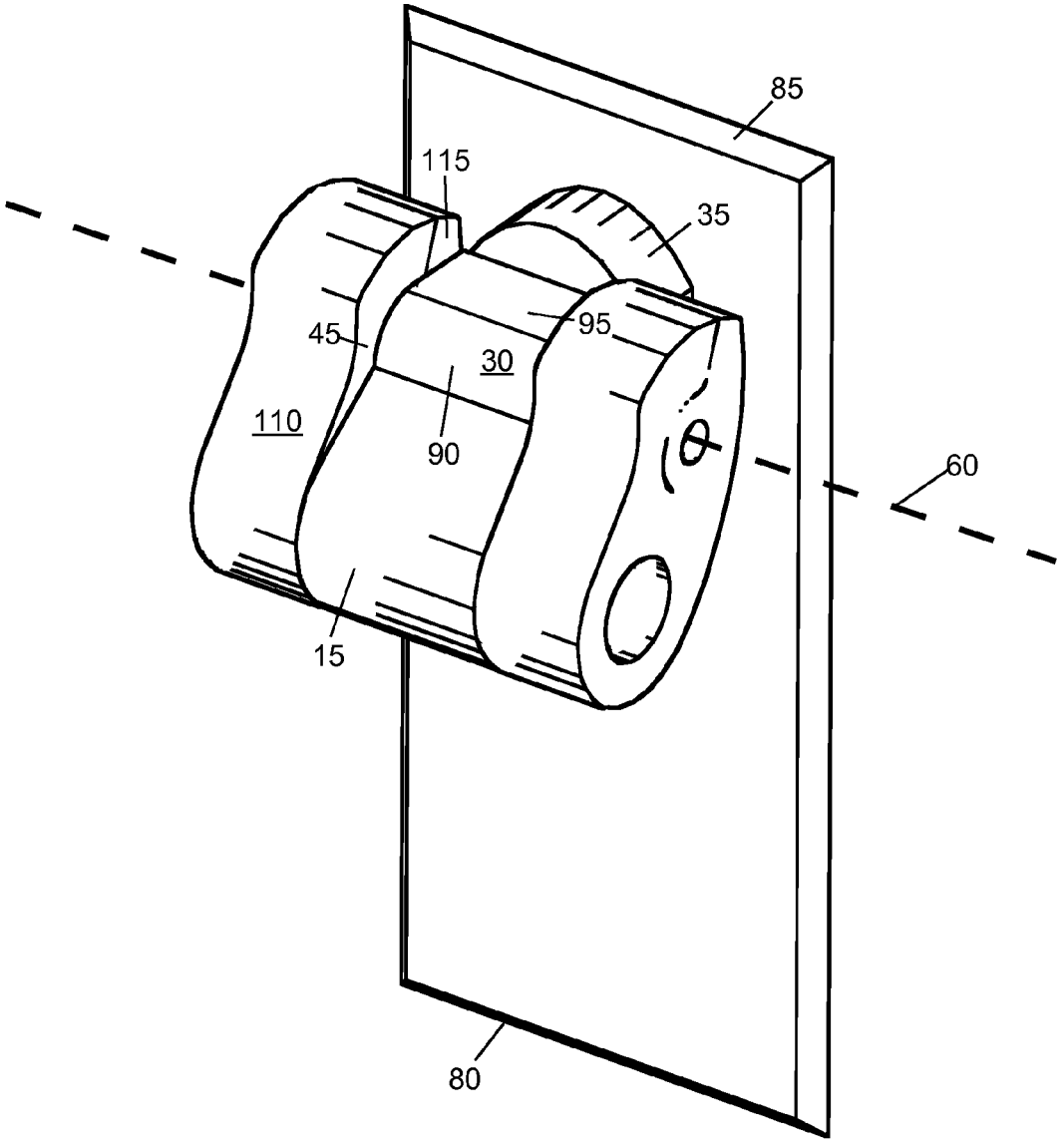
FIG. 7 is a side perspective view of a tablet arm mechanism in a storage configuration.
Figure 8:
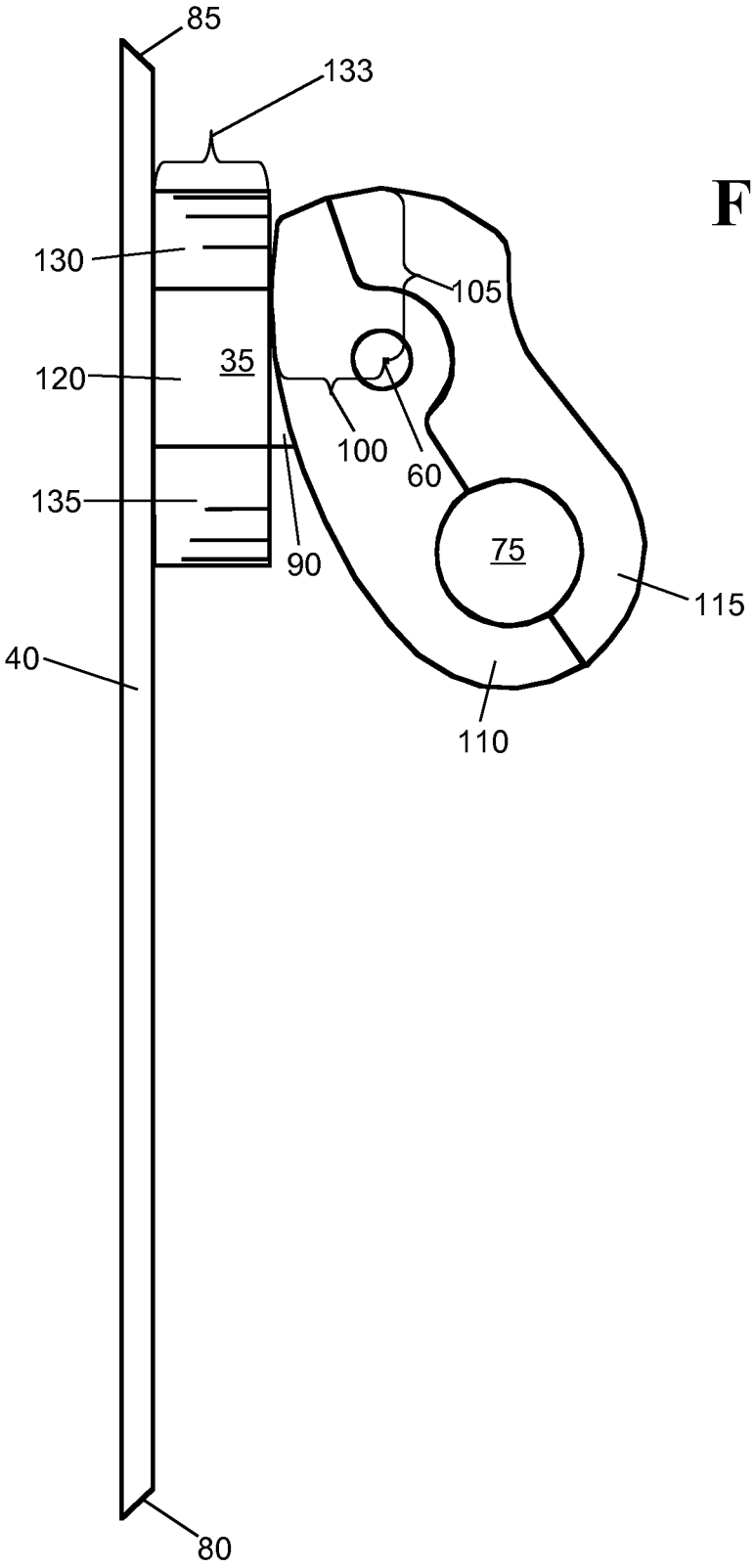
FIG. 8 is a front elevational view of a tablet arm mechanism in a storage configuration.
Figure 9:
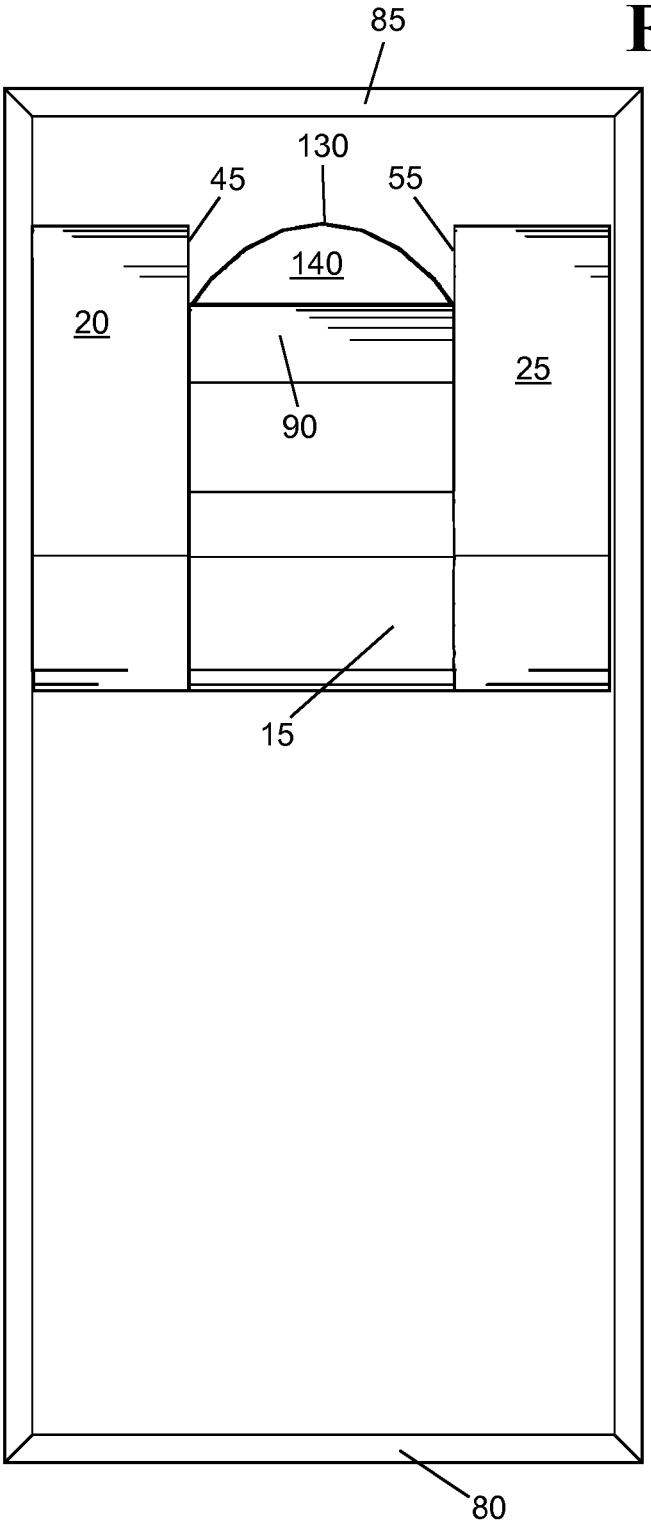
FIG. 9 is a side elevational view of a tablet arm mechanism in a storage configuration.

FIGS. 7 through 9 show an isolated view of the tablet arm mechanism 10 in the storage configuration shown in FIG. 3. As can be seen in FIG. 7, the first rotor block 30 has a cylindrical portion 90 and a block portion 95 that is connected to the second rotor block 35. The cylindrical portion 90 is concentric around the first axis of rotation 60 such that as the first rotor block 30 rotates it is kept at a constant small separation from the connector piece 15. By maintaining a constant minimally small separation, the chances of a young child having their fingers pinched during operation of the mechanism is substantially reduced. FIG. 7 also highlights the first wall 45 of the first side piece 20. As can be seen in FIG. 7, the first wall 45 is asymmetric about the first axis of rotation 60. Shown in FIG. 8, the first wall 45 extends a horizontal distance 100 from the first axis of rotation 60, a vertical distance 105 from the first axis of rotation 60, and the vertical distance 105 is greater than the horizontal distance 100. In FIG. 8, the second rotor block 35 is shown having a first height 133 parallel to the second axis of rotation. The tablet plate is secured to the second rotor block and is separated from the first rotor block by the first height 133.

The first wall 45 need not be made from a single unit. As shown in FIGS. 7 and 8, the first wall 45 is constructed from a first block of metal 110 and a second block of metal 115. Other materials that could be used in the construction of the tablet mechanism include wood and polymers.

Highlighted in FIGS. 8 and 9, the second rotor block 35 has a first flat side 120 and a second flat side 125 (not shown in FIGS. 8 and 9) that are parallel to each other and both extend from a first convex side 130 to a second convex side 135. The flat sides (120, 125) are separated from each other by approximately the first distance 50 and are of sufficient rigidity to prevent rotation of the second rotor block 35 relative to the first rotor block 30 when the tablet mechanism is in the use configuration with the tablet plate 50 horizontally oriented. While the flat sides (120, 125) act to inhibit rotation when the tablet arm mechanism is in the use configuration, the shape of the convex sides (130, 135) helps to prevent the creation of pinch points as the second rotor block 35 is rotated about the second axis of rotation. While it is contemplated that a second rotor block 35 could have four flat sides arranged in a rectangular configuration, utilization of four flat sides could create a pinch point between the second rotor block and the first block of metal 110 when the second rotor block is rotated.

In addition to the first flat side 120 and the second flat side 125, the illustrated second rotor block 35 has a flat rotation side 140 which is directly adjacent to a flat side of the cylindrical portion 90 of the first rotor block 30. As with many of the features of the tablet mechanism, in the embodiment shown there is only a minimal gap between the flat rotation side 140 and the first rotor block 30 such that a small child using the tablet mechanism would not be able to pinch their fingers between the first and second rotor blocks.

Figure 10:
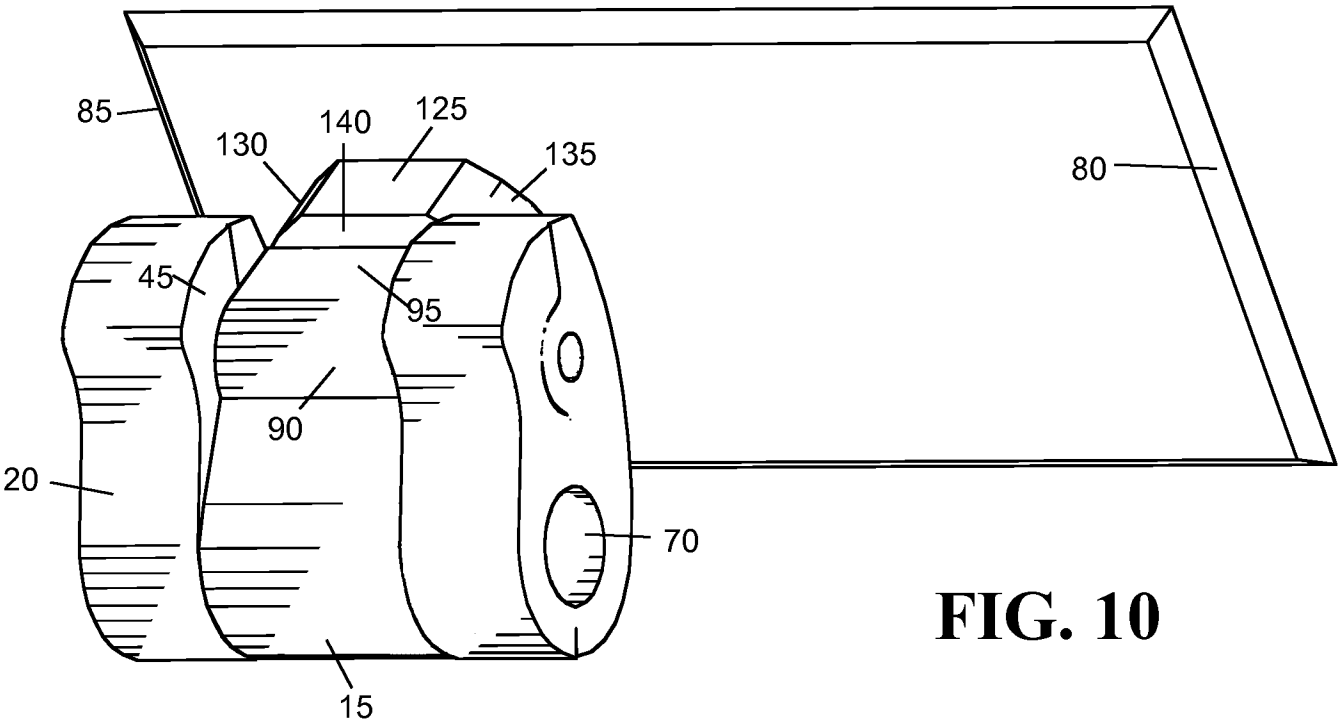
FIG. 10 is a side perspective view of a tablet arm mechanism in a first transition stage.
Figure 11:
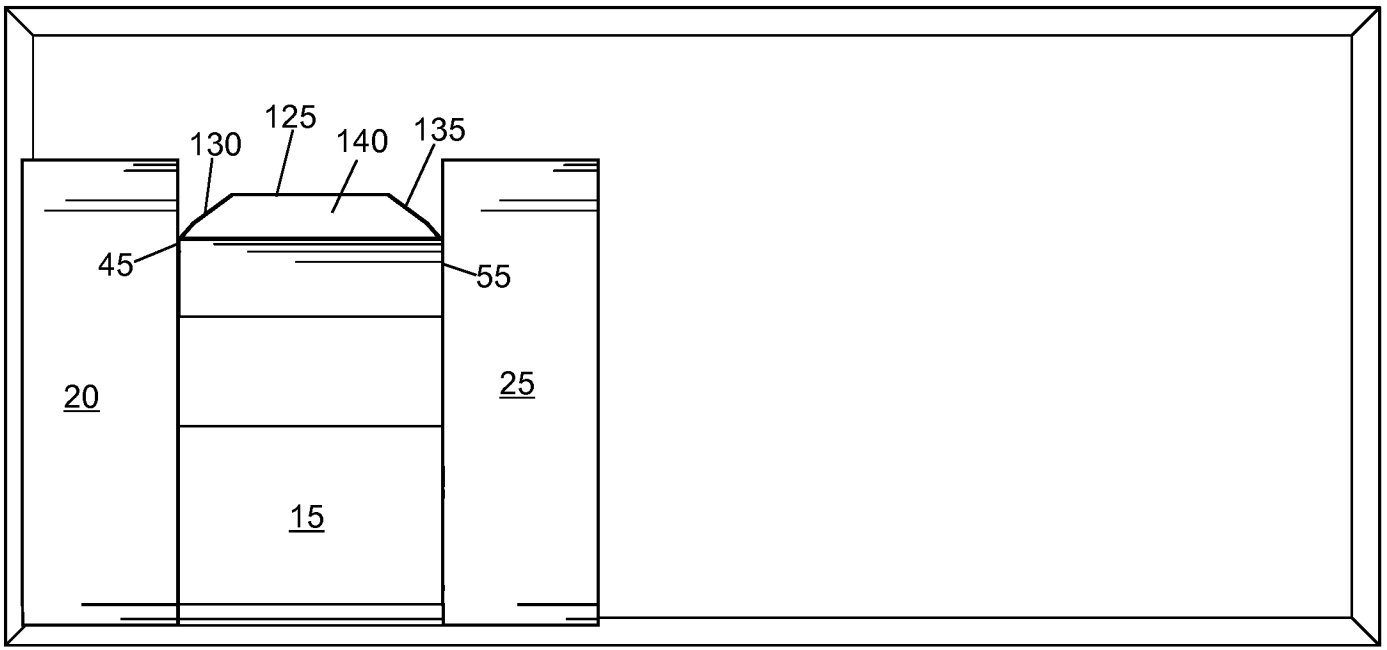
FIG. 11 is a side elevational view of a tablet arm mechanism in a first transition stage.
Figure 12:
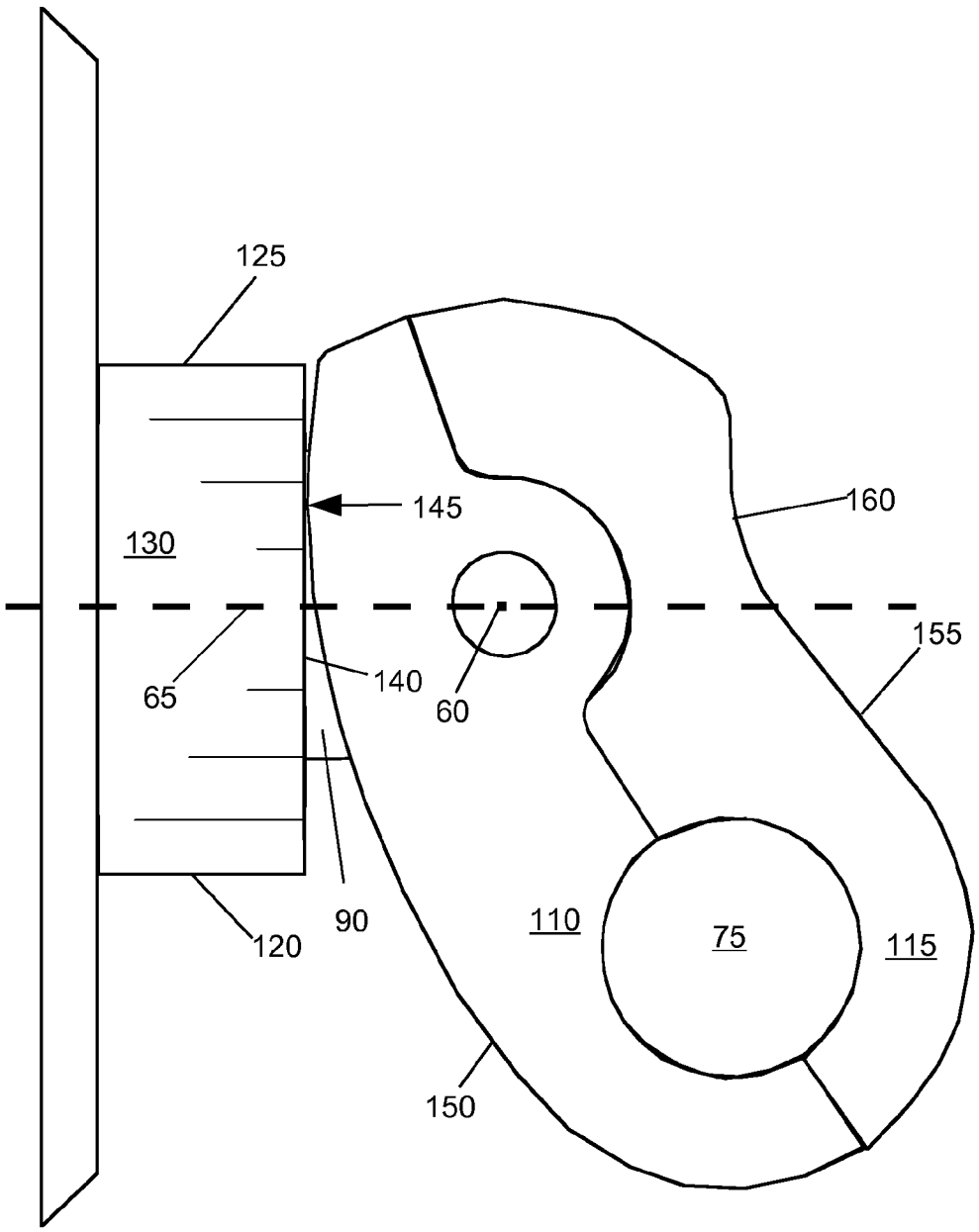
FIG. 12 is a front elevational view of a tablet arm mechanism in a first transition stage.

FIGS. 10 through 12 show isolated views of the tablet mechanism in the configuration shown in FIG. 4. The second flat side 125 of the second rotor block 35 which was not visible in FIGS. 8 and 9 is shown in FIGS. 10 through 12. Highlighted in FIG. 12, there is a slight gap 145 between the flat rotation side 140 of the rotation mechanism and the curved outer wall 150 which allows for rotation of the second rotor block 35 about the second axis of rotation when the tablet plate is in a vertical orientation. On the curved inner wall 155 of the tablet mechanism, there is a concave region 160 which acts as an arm rest when the tablet arm mechanism is in the storage configuration.

Figure 13:
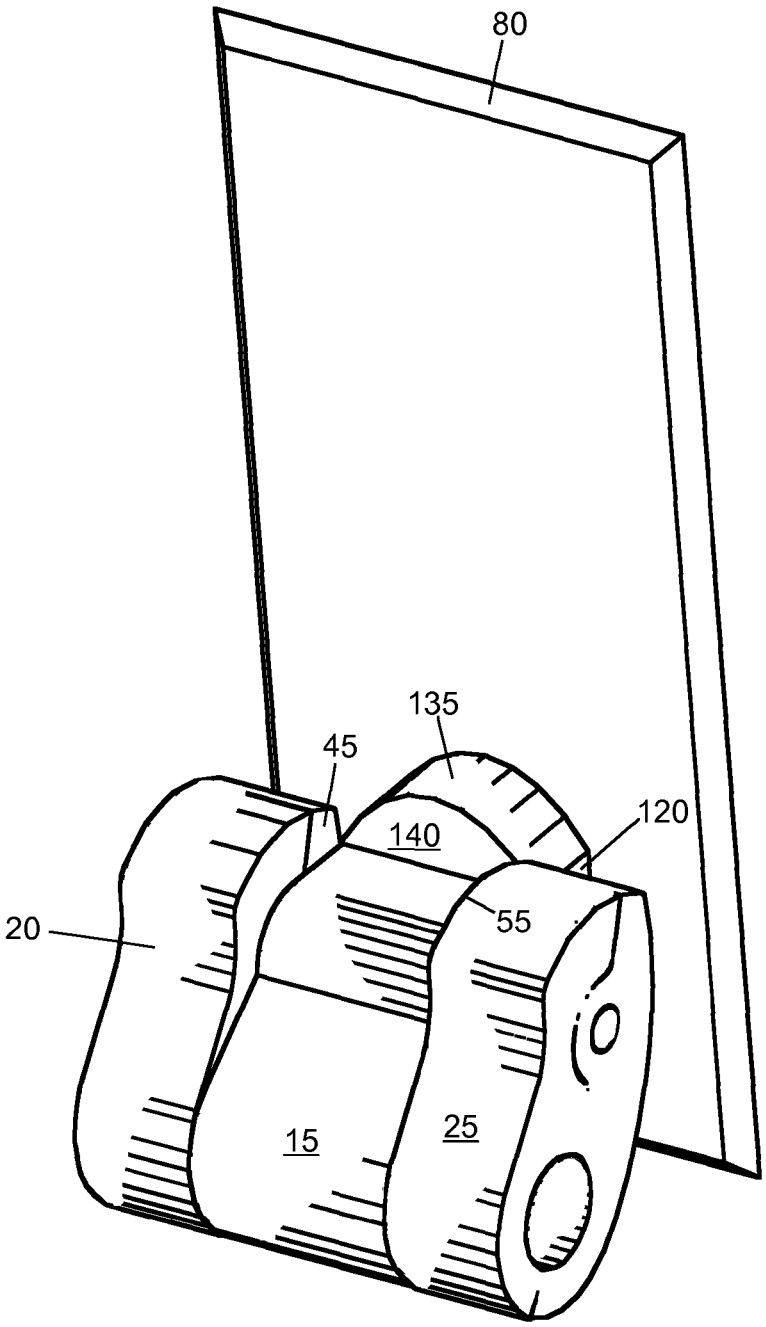
FIG. 13 is a side perspective view of a tablet arm mechanism in a second transition stage.
Figure 14:
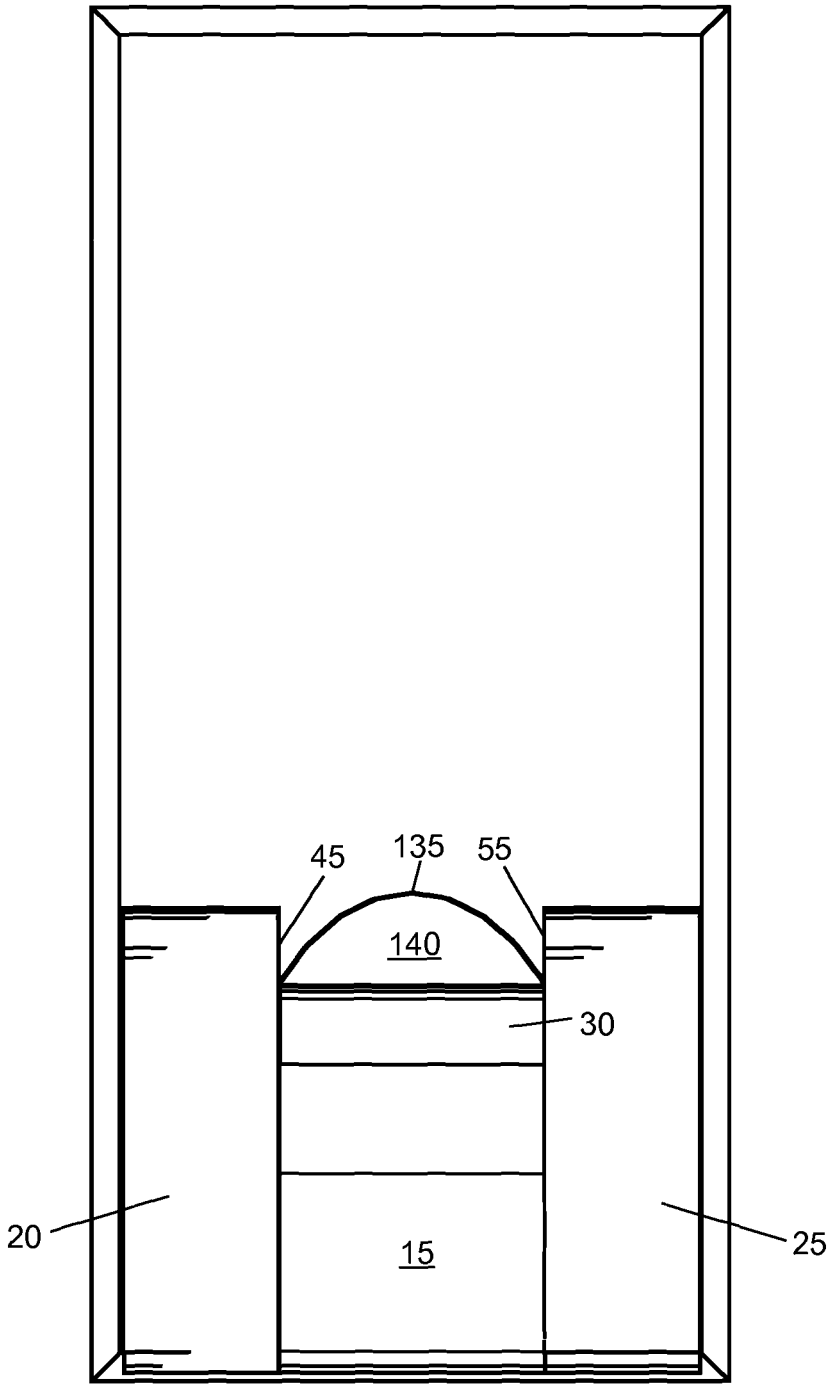
FIG. 14 is a side elevational view of a tablet arm mechanism in a second transition stage.
Figure 15:
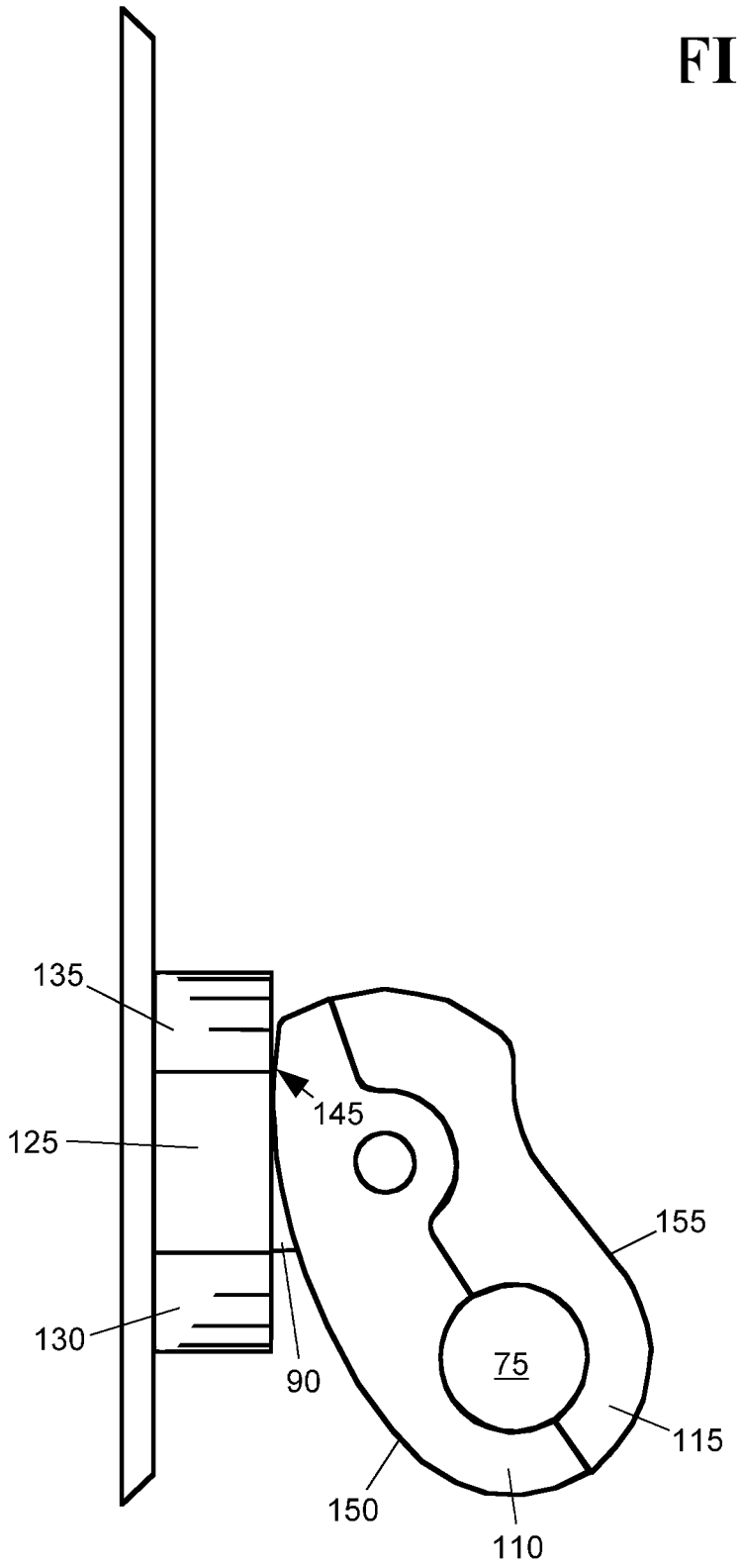
FIG. 15 is a front elevational view of a tablet arm mechanism in a second transition stage.

FIGS. 13 through 15 show the isolated tablet arm mechanism in the configuration shown in FIG. 5. While not contacting each other, the second flat side 125 of the second rotor block 35 is nearly coplanar with the first wall 45 of the first side piece 20 and the first flat side 120 of the second rotor 35 is nearly coplanar with the second wall 55 of the second side piece 25. The first wall 45 and the second wall 55 form a track in which the first and second rotor blocks (30, 35) travel when the first rotor block is rotated.

Figure 6:
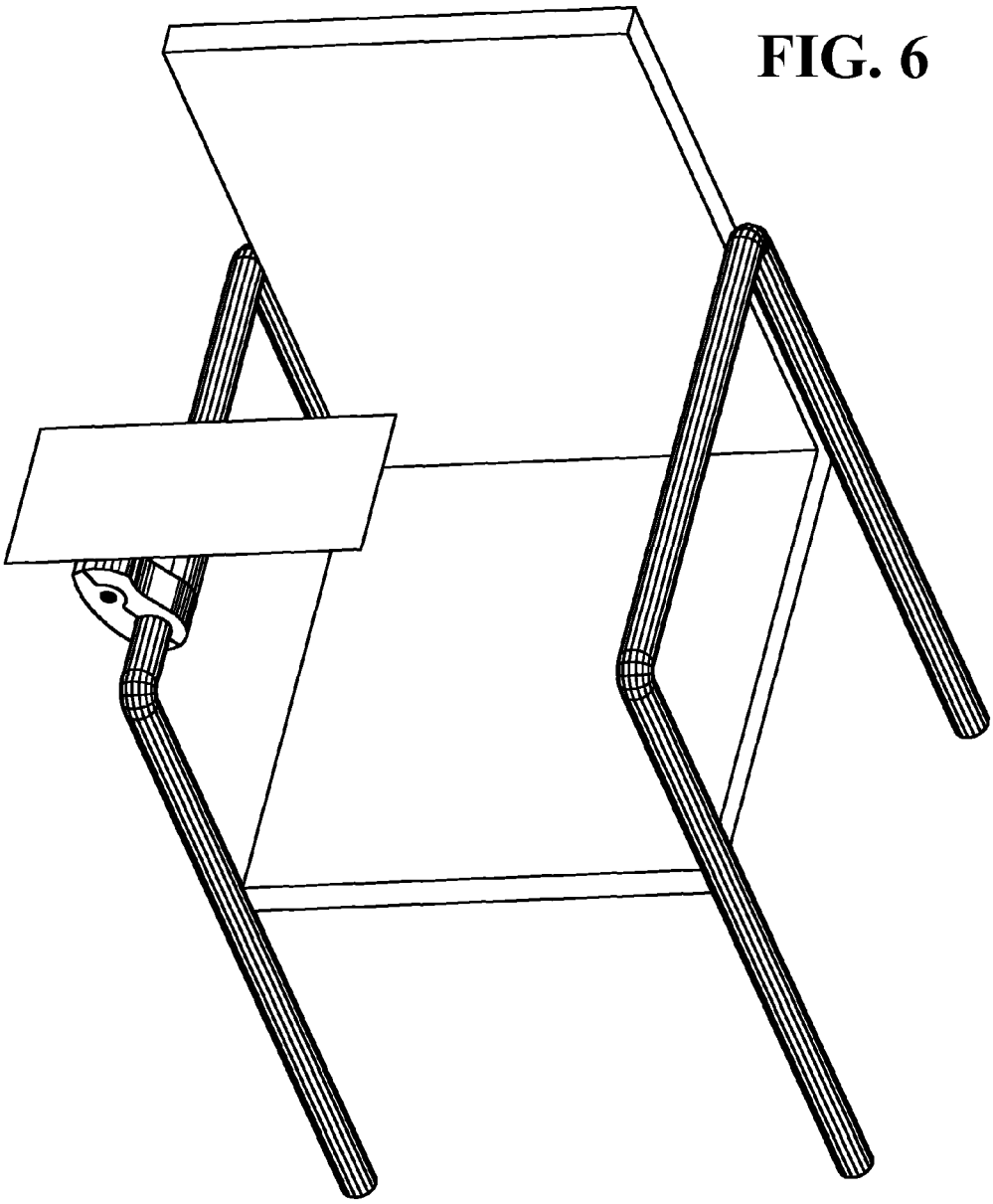
FIG. 6 is an upper perspective view of a tablet arm mechanism attached to a chair and in a use configuration.
Figure 16:
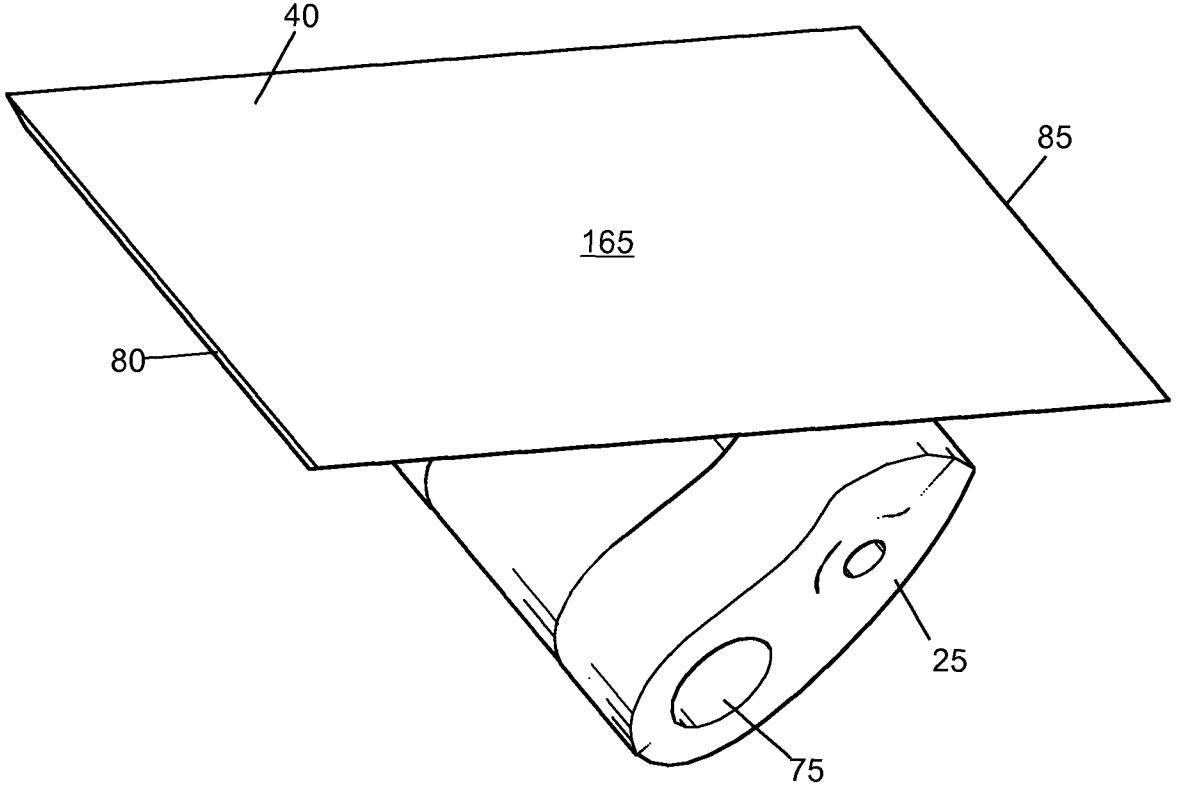
FIG. 16 is a side perspective view of a tablet arm mechanism in a use configuration.
Figure 17:
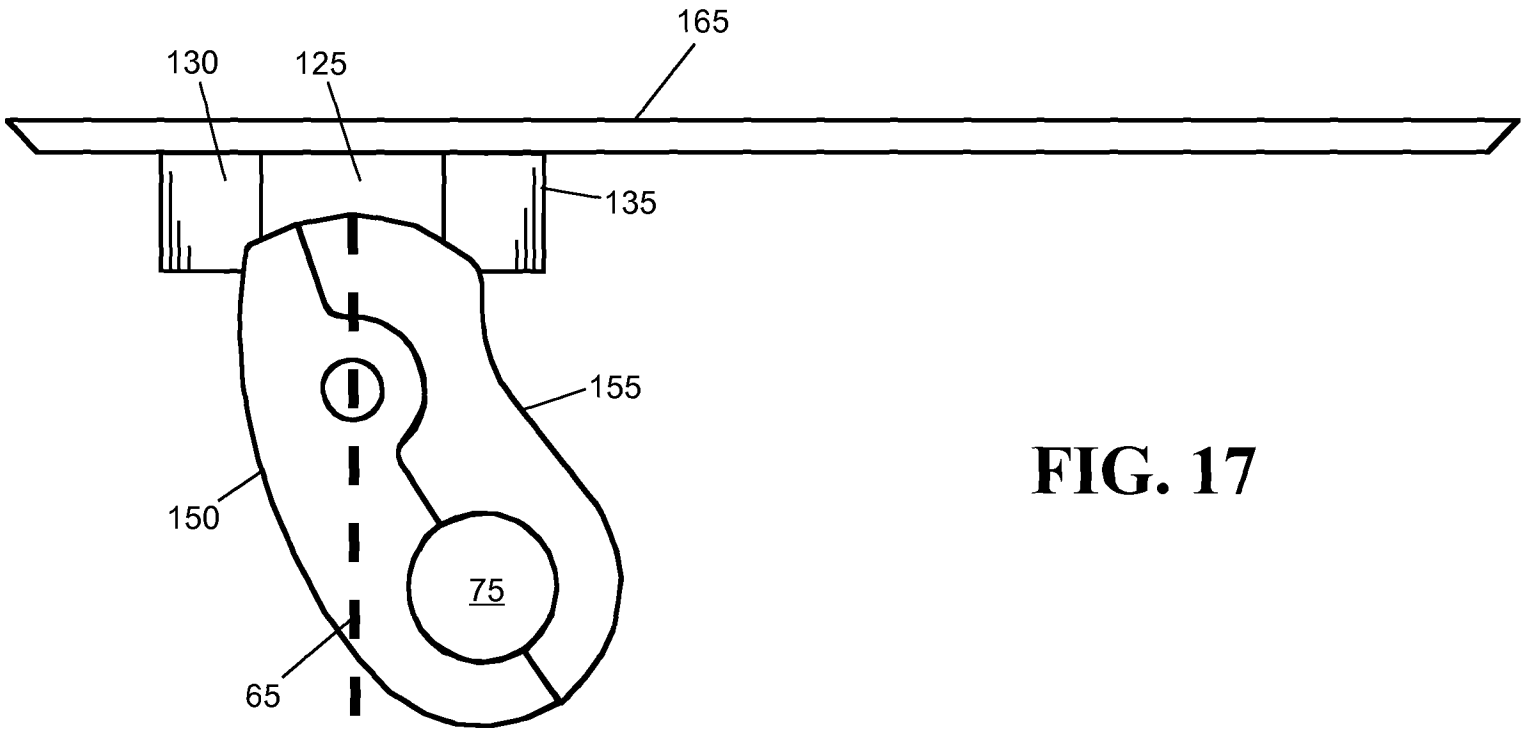
FIG. 17 is a side elevational view of a tablet arm mechanism in a use configuration.

FIGS. 16 and 17 show an isolated tablet arm mechanism in the use configuration shown in FIG. 6 where the main surface 165 of the tablet plate 40 is horizontally aligned. In the configuration shown, the first wall 45 is aligned with and directly adjacent to the first flat wall 125 of the second rotor block 35. The second wall 55 is directly adjacent to the second flat wall 130 of the second rotor block 35. The interaction of the adjacent walls acts to limit the rotation of the second rotor block relative to the first rotor block about the second axis or rotation 65. When the mechanism is in the configuration shown in FIG. 6, if the second rotor rotates slightly, a portion of the first wall will contact the second rotor block, a portion of the second wall will also contact the second rotor block and rotation will be inhibited. The tablet plate 40 (and the optional table top mounted on the table plate) provide a substantial amount of leverage that can be applied to the second rotor block. It is expected that the tablet arm mechanism will be used in challenging environments, such as high schools, so the inventor contemplates the adjacent walls will be constructed from highly resilient material, such as hardened metals or a reinforced material. As shown in FIGS. 8, 12, 15, and 17, the tablet plate 40 is always distant from both the first wall 45 and the second wall 55 in the illustrated example.

Figure 18:
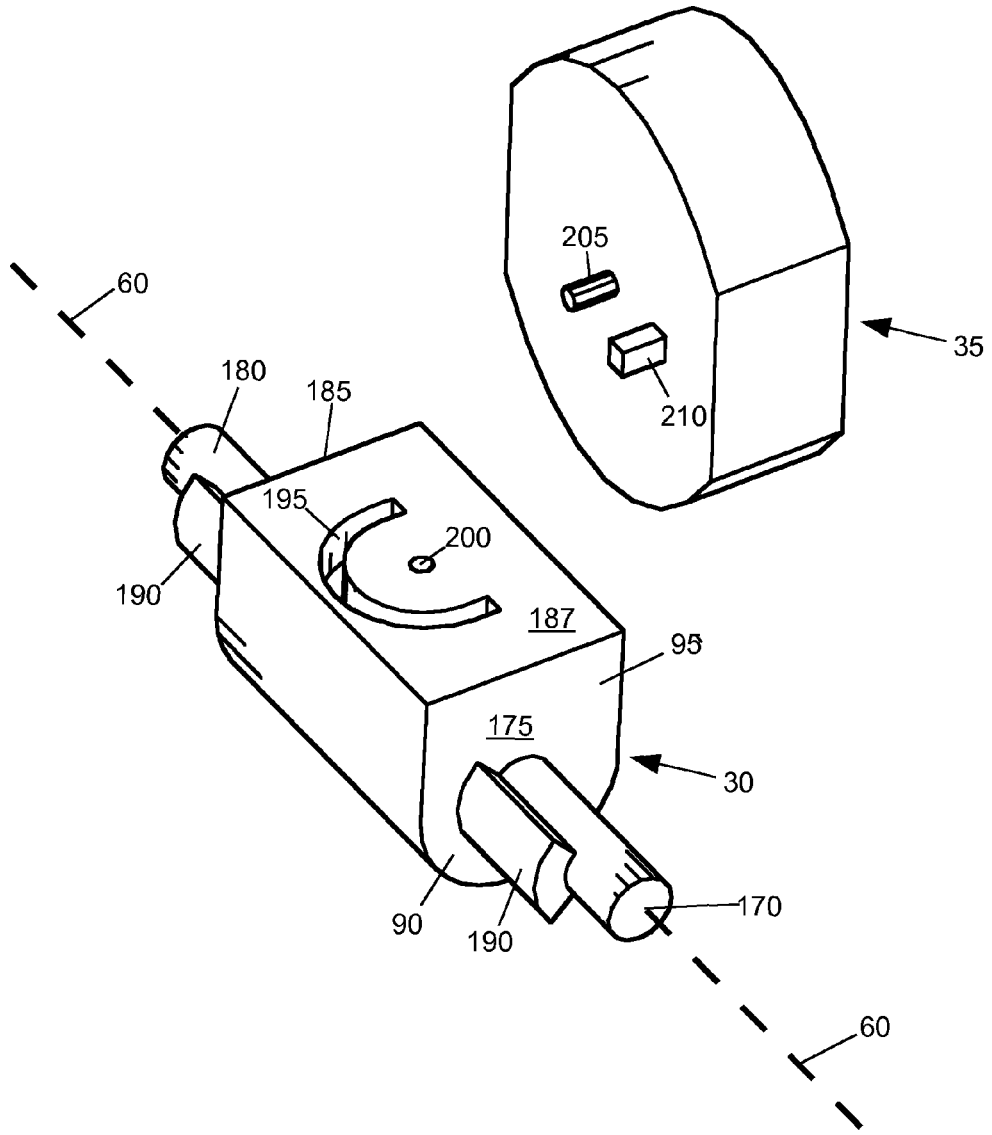
FIG. 18 shows an isolated view of a first rotor block and a second rotor block.

FIG. 18 shows an isolated view of the first rotor block 30 and the second rotor block 35. The first rotor block 30 includes a cylindrical portion 90 and a block portion 95, at the intersection of the cylindrical portion 90 with the block portion, a first dowel 170 extends from a first side 175 of the first rotor block 30 while a second dowel 180 extends away from the first dowel at the second side 185 of the first rotor block 30. In the illustrated example, the lengths of the dowels are substantially equal to the widths of the first and second side pieces. However, it should be appreciated that in some embodiments the dowels will be longer or shorter than the side pieces. It should also be appreciated that in alternate embodiments other devices or features will be used to rotatably secure the first rotor block between the first and second walls. The inventor also contemplates using shoulder bolts for the rotatable connections. In one example, the lengths of the dowels are less than the width of the side pieces (20, 25) such that the dowels are not readily visible when the tablet mechanism 10 has been fully assembled. The side pieces (20, 25) may have walls that abut with the ends of the dowels such that the dowels are completely hidden when the tablet mechanism is fully assembled. Extending from each of the dowels is a rotation limiter 190 that acts to restrict the rotation of the first rotor block 30 about the first axis of rotation 60. In the illustrated example, the rotation limiters 190 are roughly in the shape of a wedge however other shapes, such as a cylindrical pin or a rectangular box extending away from the dowel (170, 180) perpendicular to the first axis of rotation 60 may also be used. In an exemplary embodiment, screws extend through the first and second side pieces (20, 25) into the track in which the rotation limiter travels, by decreasing the size of the rotation limiter's track, the mechanism can be adjusted such that the tablet plate is level when the tablet mechanism is in the use configuration. See FIG. 27, for further details.

The block portion 90 has a rotor surface 187 adjacent to the second rotor block 35 that includes a semi-circular track 195 and a cylindrical hole 200. The second rotor 35 includes a center pin 205 aligned with the second axis of rotation and adapted to be secured within the cylindrical hole 200 of the first rotor block 30. The rotation pin 210 extends parallel to the center pin 205 and is configured to travel within the semi-circular track 195 of the first rotor block 30. As with the rotation limiters on the dowels (170, 180), the rotation pin 210 acts to limit the rotation of the second rotor block 35 about the second axis of rotation. In the illustrated example, the rotation limiters 190 on the dowels (170, 180) limit the rotation about the first axis of rotation 60 to approximately 90 degrees while the rotation pin 210 on the second rotor block 35 limits the rotation about the second axis of rotation to about 180 degrees. Transitioning from the configuration shown in FIG. 3 to the configuration shown in FIG. 5 the second rotor block rotates approximately 180 degrees.

While the second rotor block is shown with a rotation limiting pin and the first rotor block has wedge shaped structures, it should be appreciated that the type of rotation limiters may be switched between the rotors, or both rotor blocks may use wedges or both rotor blocks may use pins to limit rotation. The center pin of the second rotor block may be in the form of a screw or other fastener that extends fully through both the first rotor block 30 and the second rotor block 35.

Figure 19:
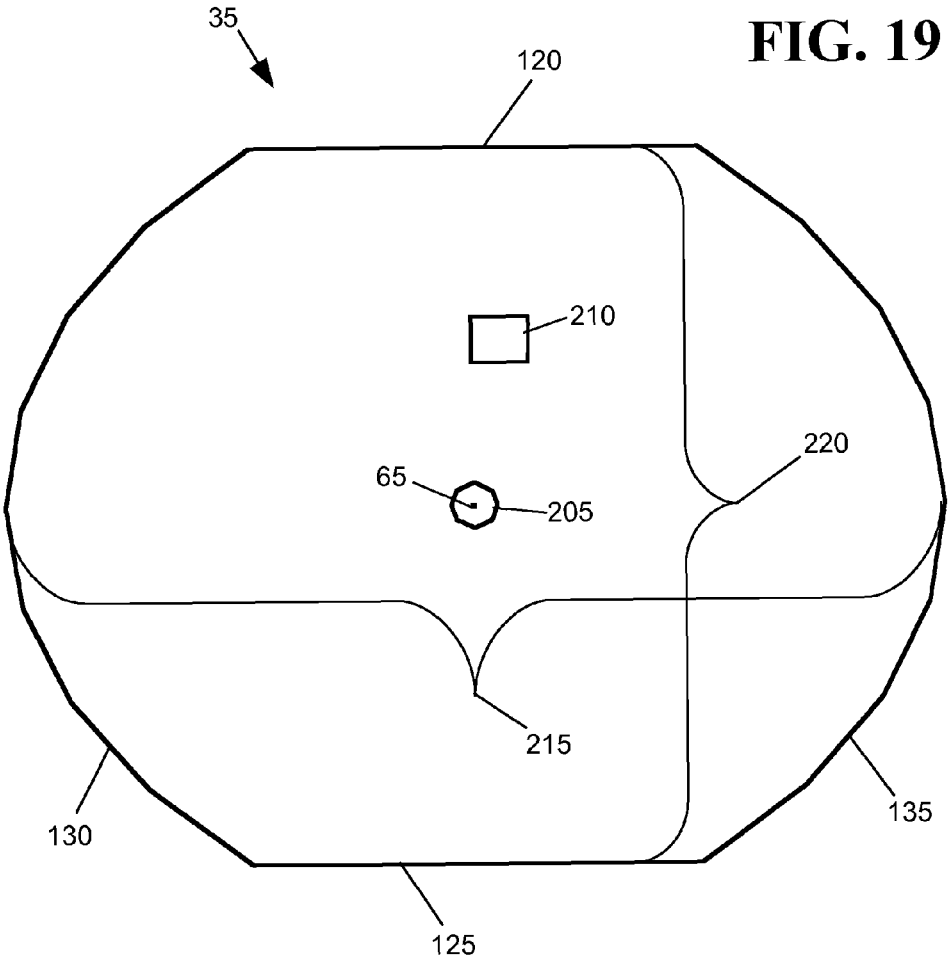
FIG. 19 shows an isolated bottom plan view of a second rotor block.

FIG. 19 shows a bottom view of the second rotor block 35. The second rotor block has a first width 215 and a second width 220 that are both perpendicular to the second axis of rotation 65. The first width extends from the first convex surface 130 to the second convex surface 135 while the second width extends from the first flat side 120 to the second flat side 125. The second width 220 is substantially equal to the separation of the first wall 45 from the second wall 55 (the first distance 50), while the first width 215 is substantially greater than the second width 220. The second rotor block 35 is rotatable to a configuration where the first width 215 is parallel to the first axis of rotation (see FIG. 4). Since the first width 215 is greater than the first distance 50, the second rotor block 35 is prevented from moving directly between the first wall 45 and the second wall 55 which effectively inhibits rotation of the first rotor block about the first axis of rotation. With the exception of the pin, the illustrated second rotor block 35 is symmetric about the first width 215 and the second width 220 measured through the second axis of rotation 65.

Figure 20:
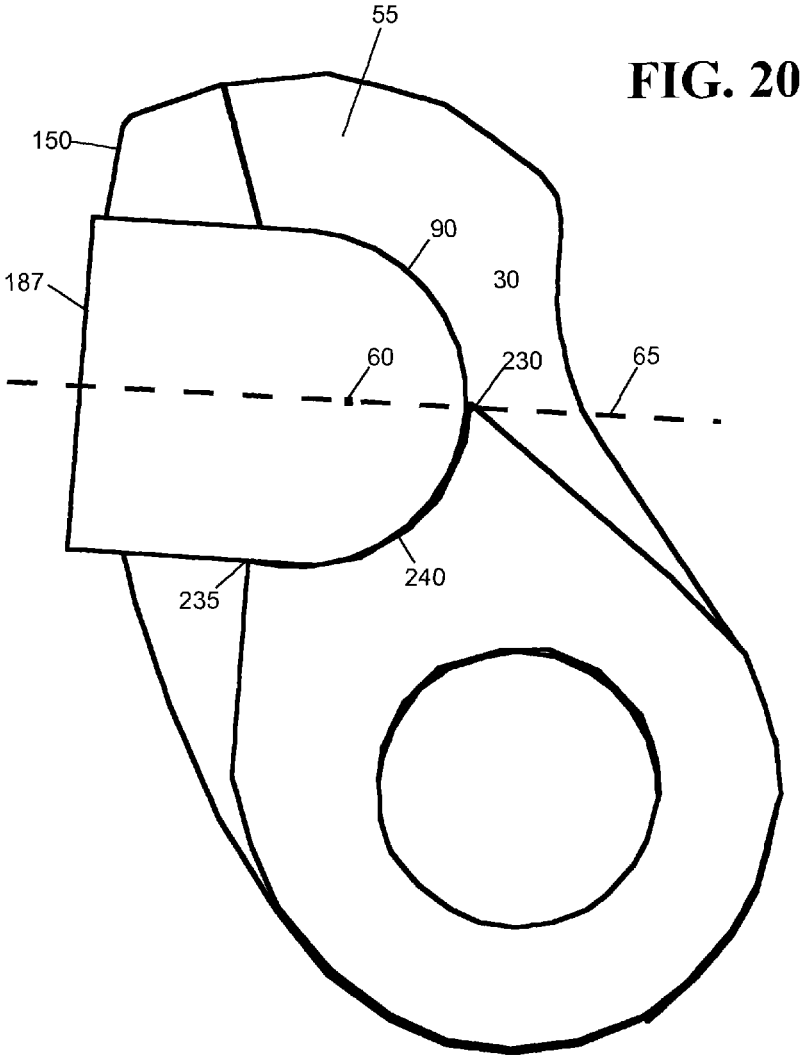
FIG. 20 shows a side-elevational cross-sectional view of a tablet arm mechanism in a storage configuration.
Figure 21:
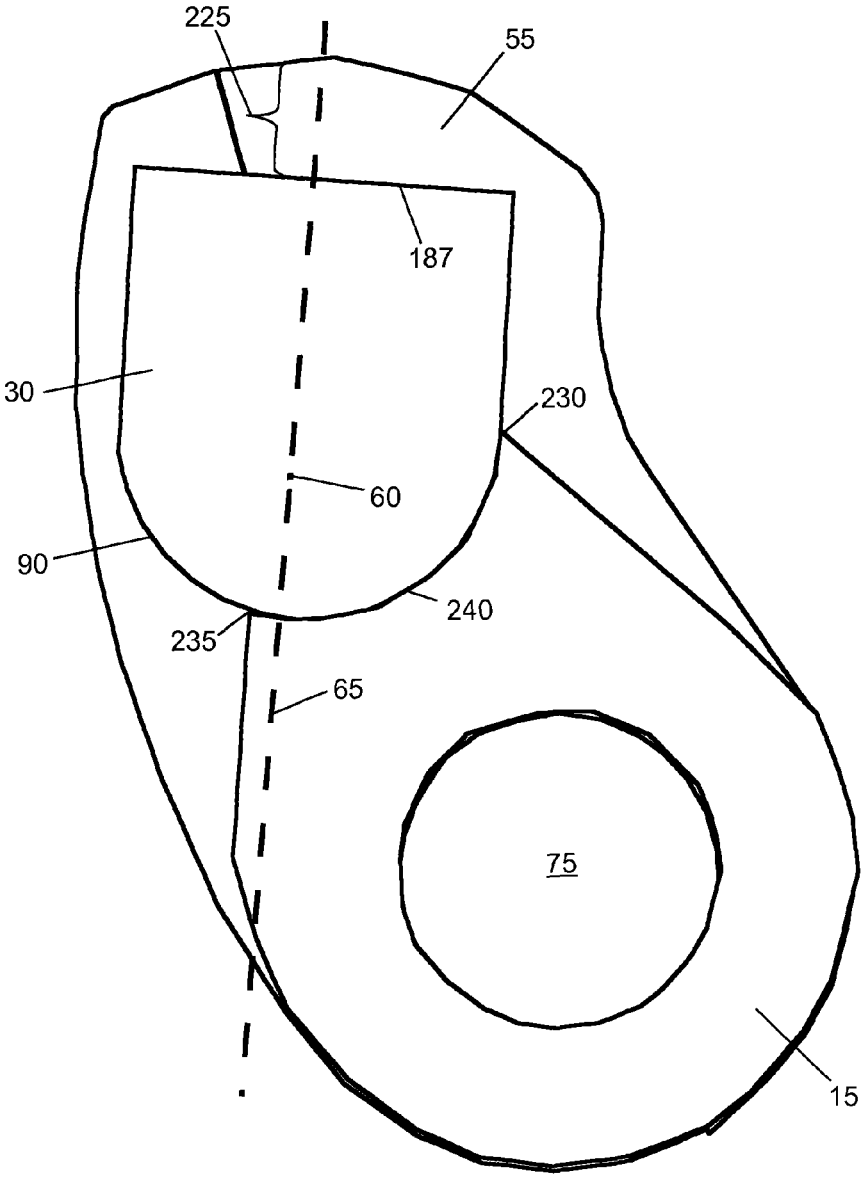
FIG. 21 shows a side-elevational cross-sectional view of a tablet arm mechanism in a use configuration.
Figure 22:
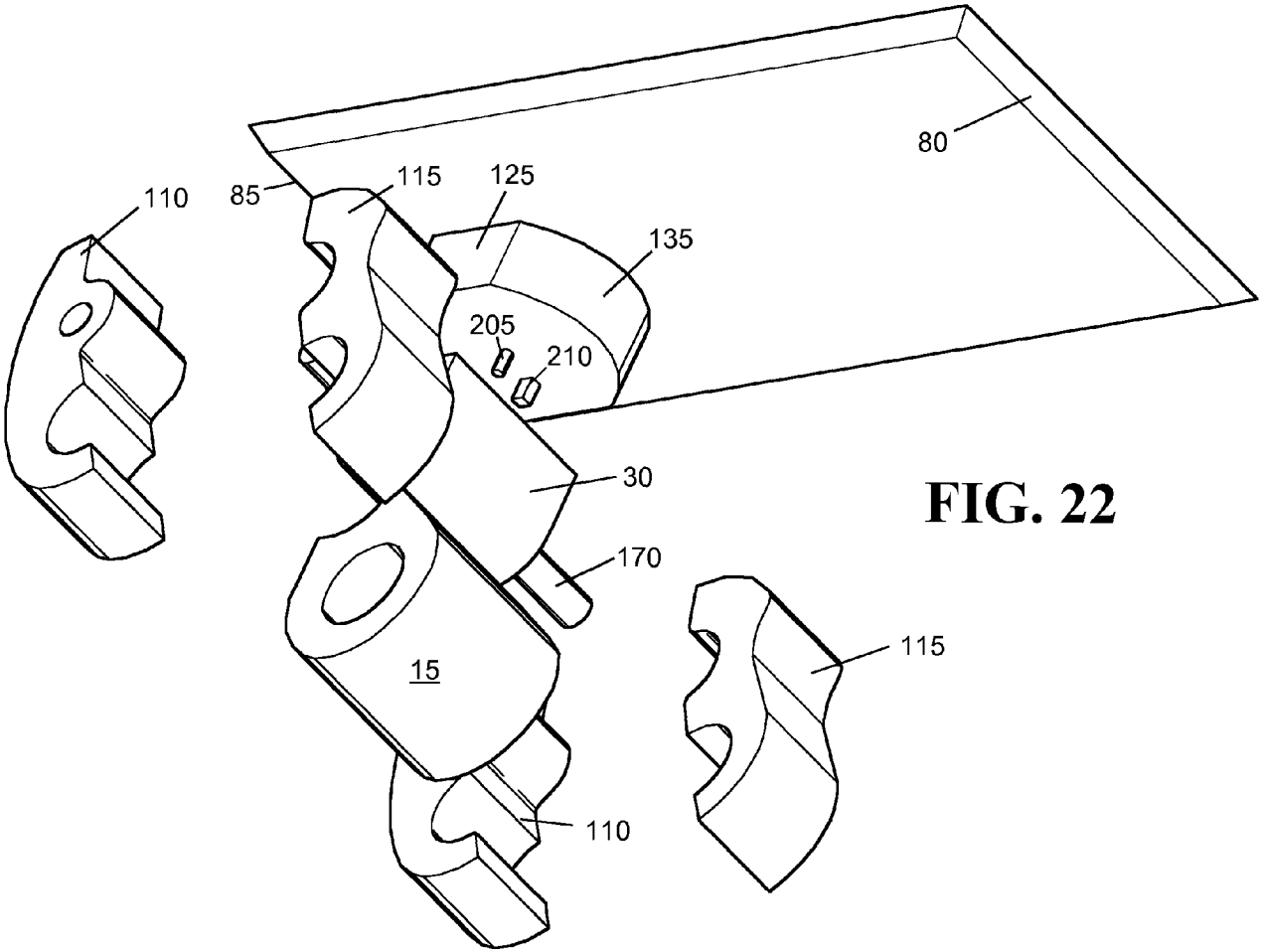
FIG. 22 shows a lower perspective view of an exploded tablet arm mechanism.
Figure 23:
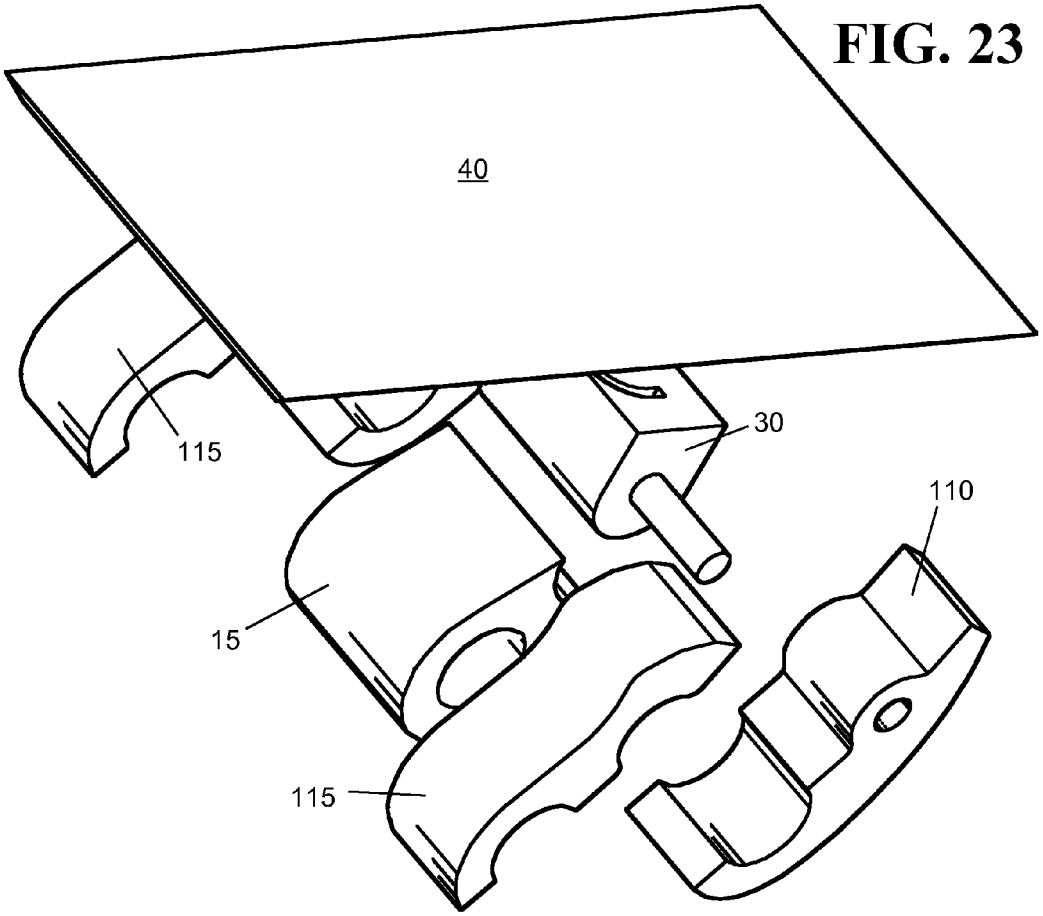
FIG. 23 shows an upper perspective view of an exploded tablet arm mechanism.
Figure 24:
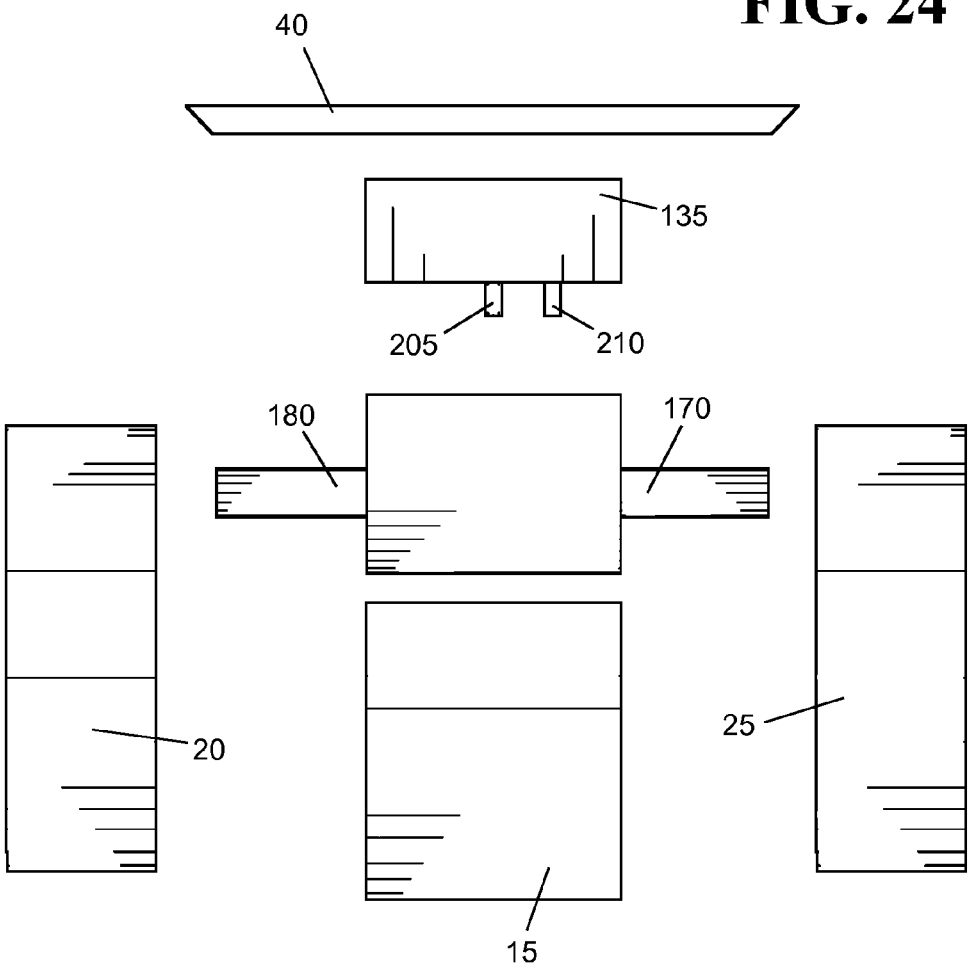
FIG. 24 shows a side elevational view of an exploded tablet arm mechanism.
Figure 25:
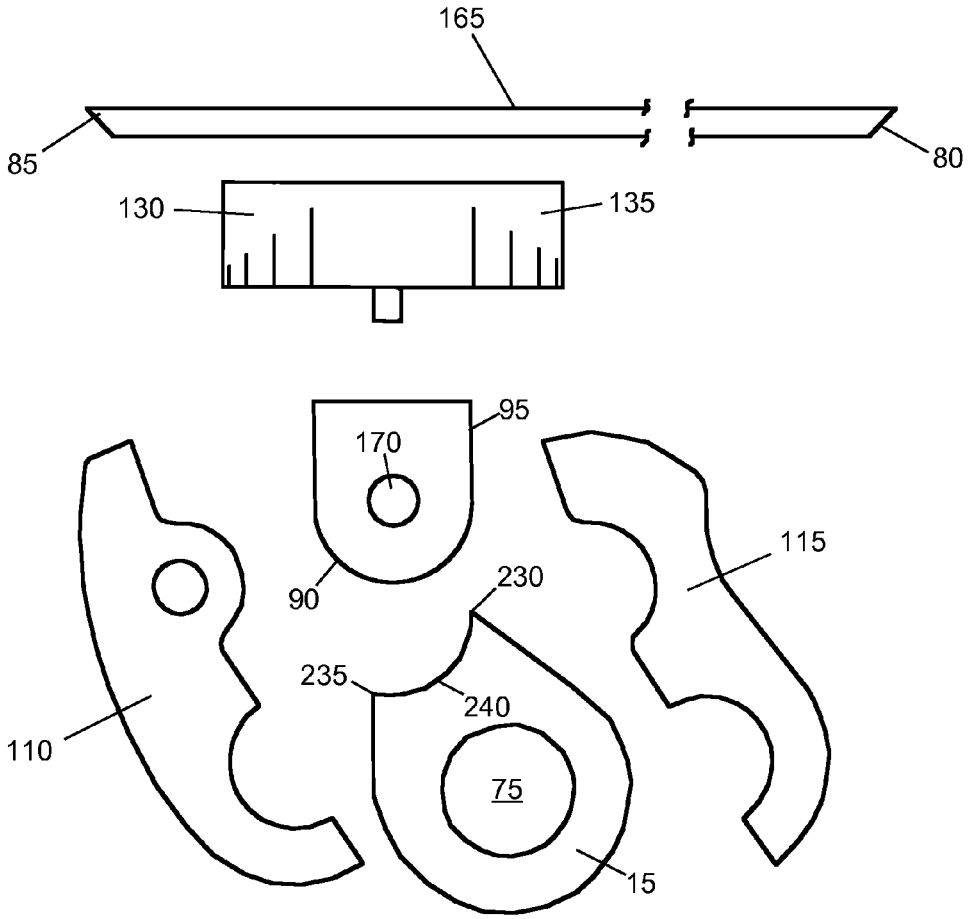
FIG. 25 shows a front elevational view of an exploded tablet arm mechanism.
Figure 26:
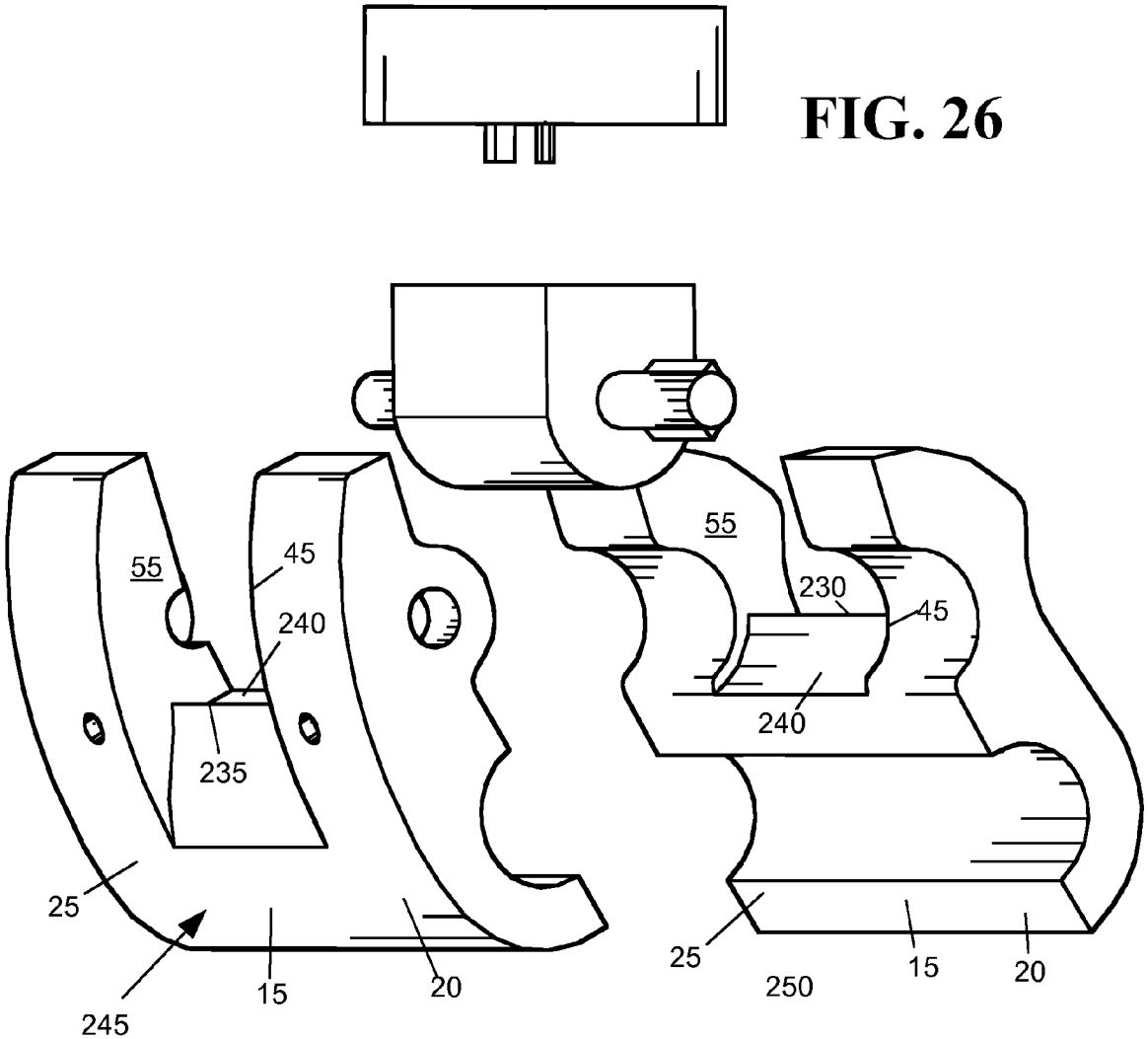
FIG. 26 shows a front perspective view of a second exploded tablet arm mechanism.

FIGS. 20 and 21 show cross sectional views of the first rotor block 30 in both a storage configuration (FIG. 20) and a use configuration (FIG. 21). These figures highlight how in the storage configuration, the first rotor block 30 extends along the second axis of rotation 65 from the first axis of rotation 60 beyond a portion of the first wall 45 (not shown) and the second wall 55 to the rotor surface 187. With the first rotor block extending past the curved first and second walls (45, 55) and the curved outer walls 150 of the side pieces, the second rotor block 35 is able to rotate about the second axis of rotation 65. In the use configuration, the first and second walls (45, 55) extend adjacent to the first rotor block away from the first axis of rotation 60 parallel to the second axis of rotation 65 past the rotor surface 187 of the first rotor block 30. The portions 225 of the first and second walls (45, 55) that extend from the rotor surface 187, away from the first axis of rotation 60 parallel to the second axis of rotation 65 act to rotationally lock the second rotor block 35 when the tablet mechanism 10 is in the use configuration. As with the flat sidewalls of the second rotor block 35, the portions 225 of the first and second walls (45, 55) that rotationally lock the second rotor block 35 may be reinforced with resilient materials.

FIGS. 22 through 25 show an embodiment of the tablet arm with eight separable components. In the illustrated example, each of the side pieces (45, 55) is constructed from two blocks that are secured together with fasteners. Between the two side pieces is the connector piece 15. Best illustrated in FIGS. 20, 21, and 25, the connector piece 15 has a first edge 230 and a second edge 235 that both fully extend from the first wall 45 of the first side piece 20 and the second wall 55 of the second side piece 25. Between the two edges (230, 235) the connector piece 15 has a concave surface 240 that extends between the two edges. The concave surface 240 is substantially defined by the cylindrical portion 90 of the first rotor block 30 and is approximately concentric with the first axis of rotation 60.

Figure 27:
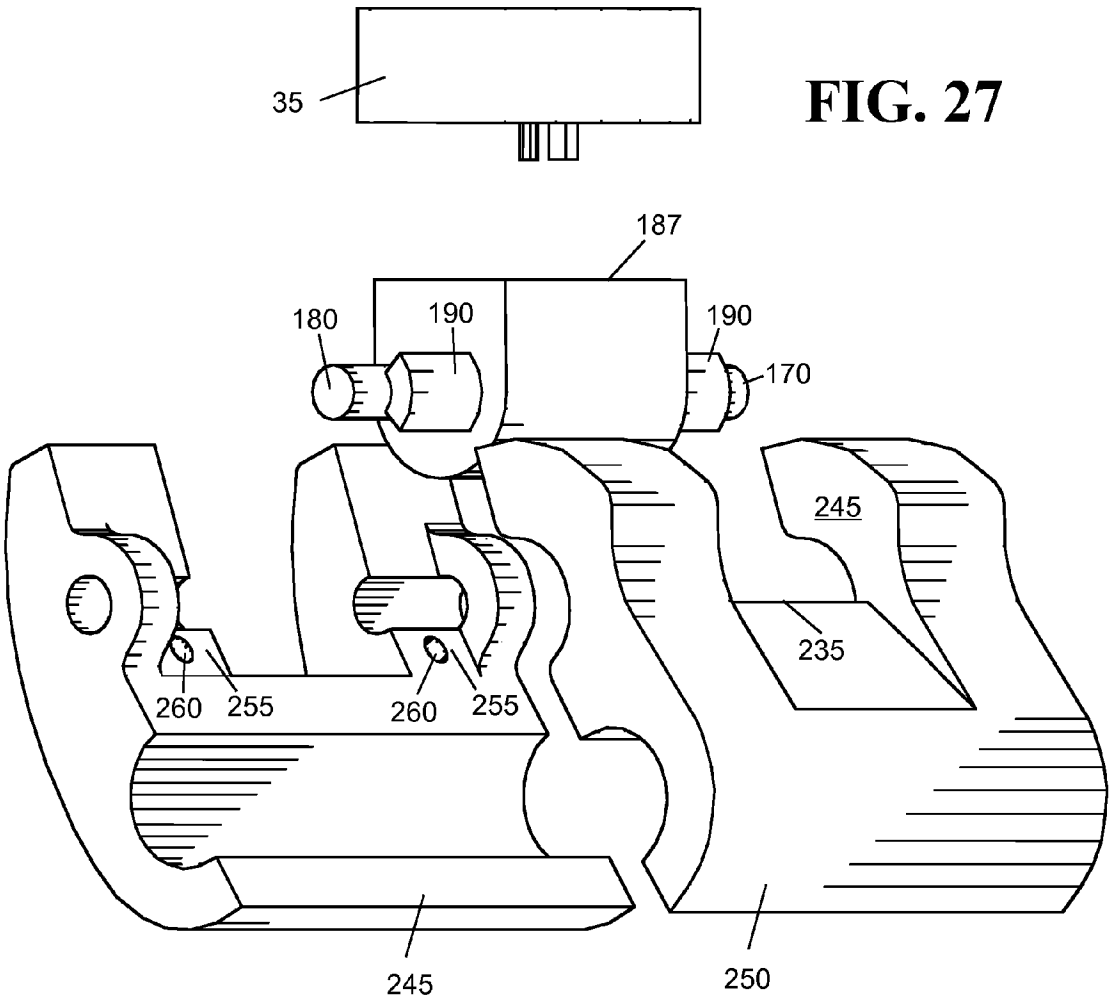
FIG. 27 shows a rear perspective view of a second exploded tablet arm mechanism.
Figure 28:
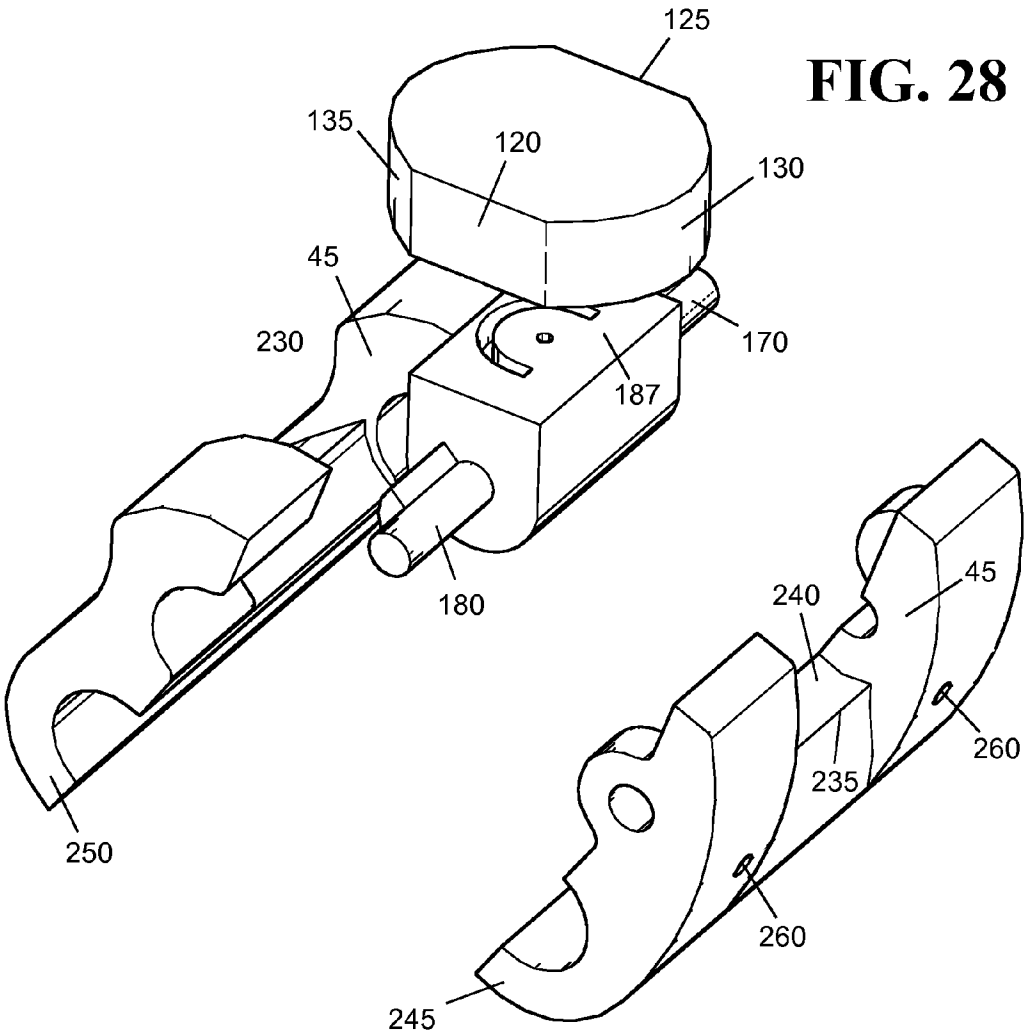
FIG. 28 shows an upper perspective view of a second exploded tablet arm mechanism.
Figure 29:
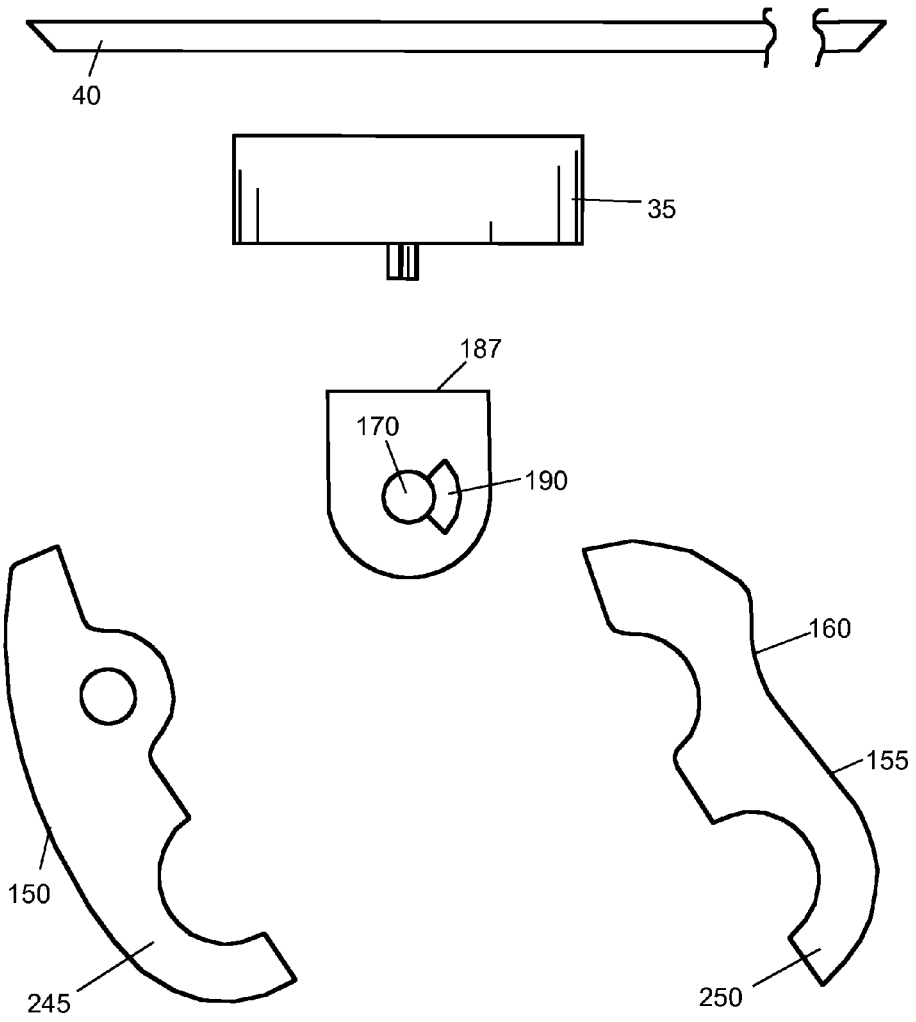
FIG. 29 shows a side elevational view of a second exploded tablet arm mechanism.

FIGS. 26 through 29 show an alternate embodiment of the tablet arm mechanism 10 with five separable components. In this embodiment, a first and second block (245, 250) each form half of each side piece (20, 25) and the connector piece 15. Despite being formed from two components, the connector piece 15 includes two edges (230, 235) that fully extend from the first wall 45 to the second wall 55 parallel to the first axis of rotation. Additionally, the connector piece 15 has a concave surface 240 (made from two unique blocks of metal) that extends between the two edges (230, 235). As with the first wall and the second wall of the side pieces, it should be appreciated that the walls (45, 55) need not be formed from a single construction. FIG. 27 shows the track 255 in which the rotation restrictors 190 of the dowels (170, 180) rotate. FIG. 27 also shows holes 260 through both the first side piece 20 and the second side piece 25. In order to provide a level tablet surface when the mechanism is in the use configuration, a user may advance screws through those holes which will limit how far the first rotor block 30 is able to rotate. FIG. 27 also illustrates the channel 75 in the side pieces and connector piece that is used to clamp onto chairs or other furniture. The two side pieces (20, 25) and the connector piece 15 each have apertures that form the channel parallel to the first axis of rotation. As can be seen in FIGS. 26 through 29, the term "piece" is not limited to individually separable components and includes portions of a single object.

Figure 30:
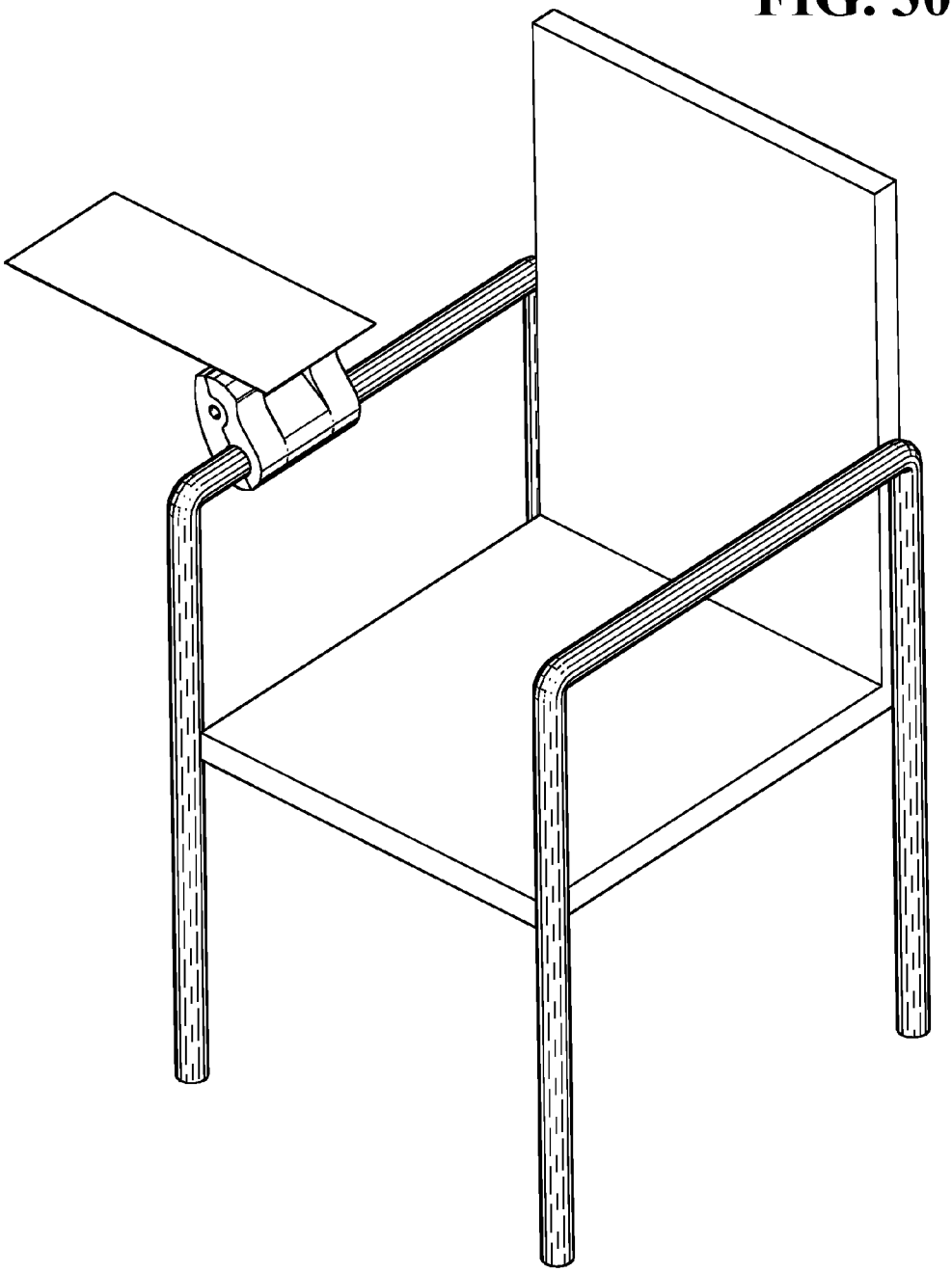
FIG. 30 is an upper perspective view of a tablet arm mechanism in an auxiliary configuration while attached to a chair.

FIG. 30 shows the mechanism in an auxiliary configuration that is achieved by rotating the first rotor block while the mechanism is in the configuration shown in FIG. 3. In the auxiliary configuration, the second flat side 125 of the second rotor block 35 is substantially coplanar with and directly adjacent to the second wall 55 of the second side piece 25. The first flat side 120 is substantially coplanar with and directly adjacent to the first wall 45 of the first side piece 20.

Figure 31:
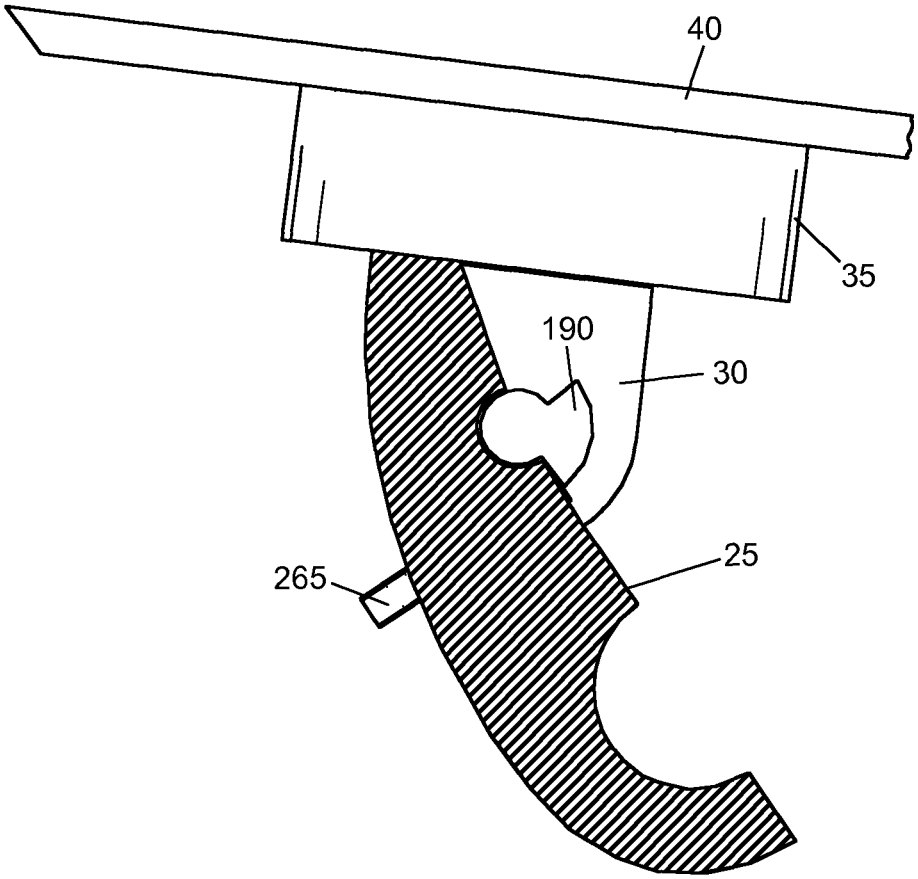
FIG. 31 is a cross sectional view of a tablet arm mechanism with a downwardly angled tablet plate.
Figure 32:
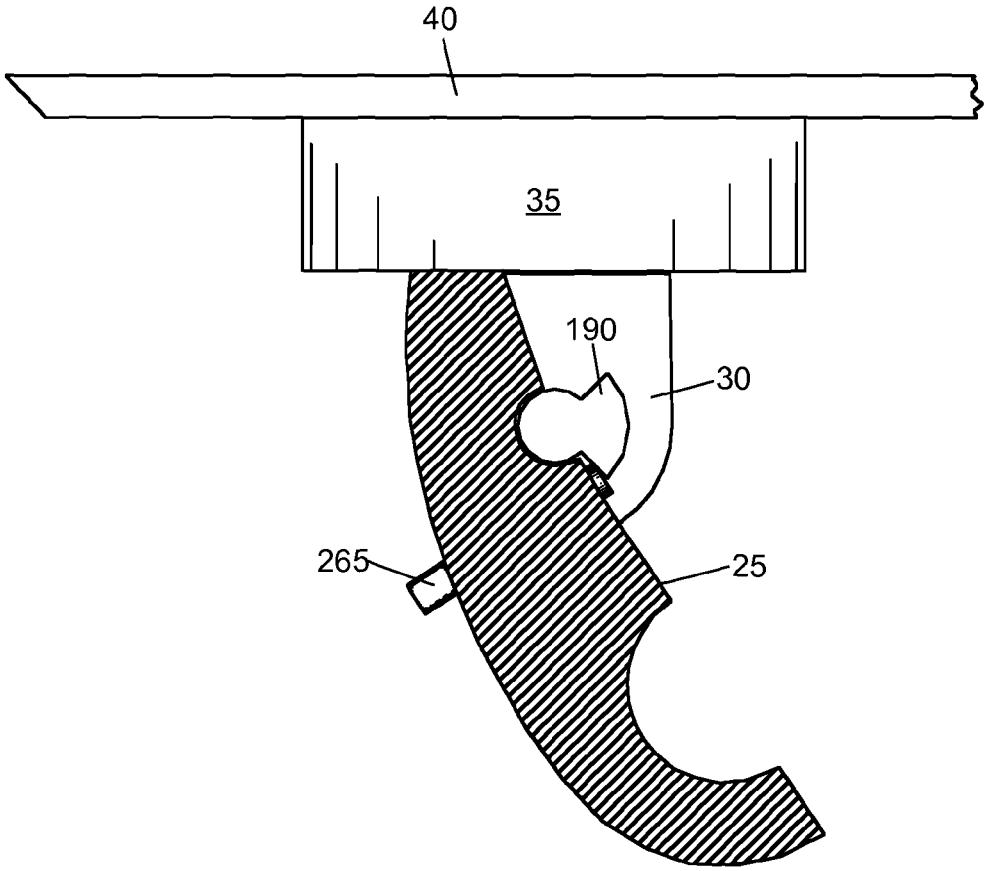
FIG. 32 is a cross sectional view of a tablet arm mechanism with a level tablet plate.
Figure 33:
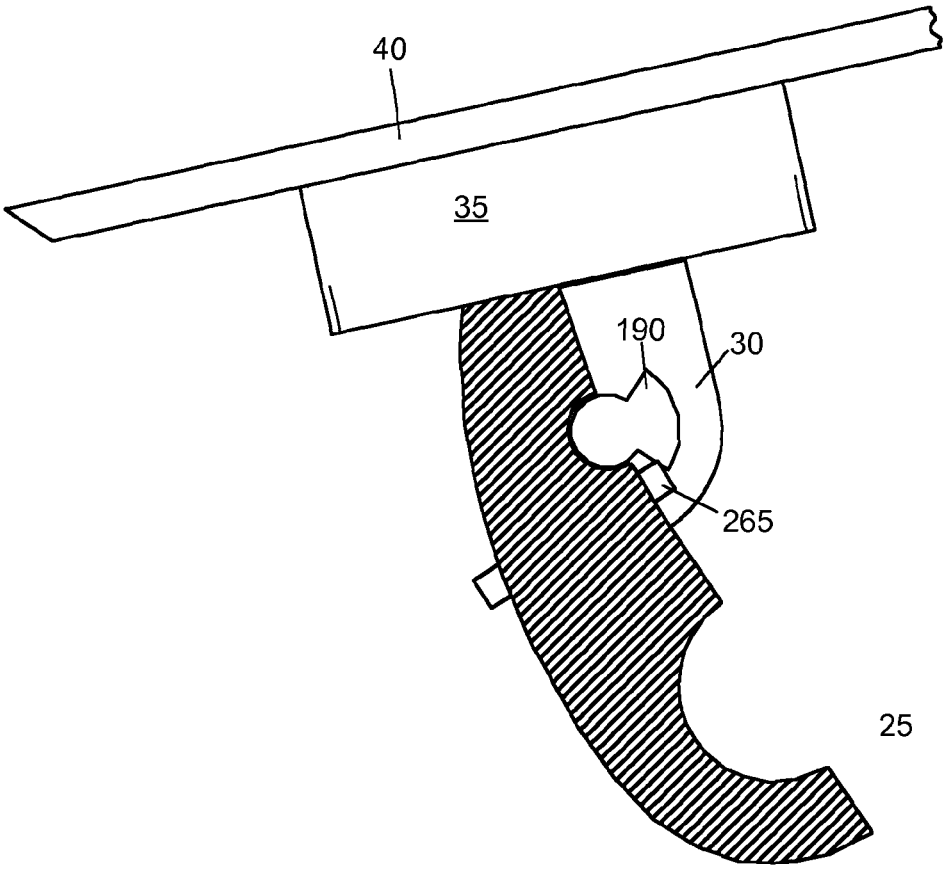
FIG. 33 is a cross sectional view of a tablet arm mechanism with an upwardly angled tablet plate.

FIG. 31 through 33 illustrate a tablet arm mechanism that is leveled based on a screw 265 passing through holes 260 and pressing against a rotation limiter 190. As the screw 265 is rotated through the hole it extends out and hits the rotation limiter 190 which decreases the amount that first rotor block 30 is able to rotate. By limiting the rotation of the first rotor block 30, the angle of the table top relative to horizontal may be adjusted.

The inventor contemplates several alterations and improvements to the disclosed invention. Other alterations, variations, and combinations are possible that fall within the scope of the present invention. Although various embodiments of the present invention have been described, those skilled in the art will recognize more modifications that may be made that would nonetheless fall within the scope of the present invention. Therefore, the present invention should not be limited to the apparatus described.

I claim:

1. A dual rotation tablet mechanism for securing a tablet arm to a furniture piece, the dual rotation tablet mechanism comprising:

a base securable to the furniture piece, the base having a first wall and a second wall, the first wall separated from the second wall by a first distance;

a first rotor rotationally secured to the base between the first wall and the second wall, the first rotor having a first axis of rotation;

a second rotor rotationally secured to the base and having a second axis of rotation substantially perpendicular to the first axis of rotation, the second rotor having a first width and a second width, the first width perpendicular to the second axis of rotation, the second width perpendicular to both the second axis of rotation and the first width, the first width being substantially equal to the first distance, and the second width being greater than the first distance;

the second rotor having a first height on the second axis of rotation, a tablet connection plate secured to the second rotor; and the tablet connection plate separated from the first rotor by the first height.

2. The dual rotation tablet mechanism of claim 1 further comprising:

the tablet connection plate secured to the second rotor and configured to be secured to the tablet arm, wherein the tablet connection plate is always distant from both the first wall and the second wall.

3. The dual rotation tablet mechanism of claim 1 further comprising:

the second rotor secured adjacent to a rotor surface of the first rotor, the dual rotation tablet mechanism transforms from a use configuration to a storage configuration, wherein in the use configuration both the first wall and the second wall extend parallel to the second axis of rotation from the rotor surface away from the first axis of rotation adjacent to the second rotor; and in the storage configuration the first rotor extends parallel to the second axis of rotation away from the first axis of rotation beyond both the first wall and the second wall to the rotor surface.

4. The dual rotation tablet mechanism of claim 1 further comprising:

the first rotor having a cylindrical portion and a block portion, the base having a connector piece extending from the first wall to the second wall, the connector piece having a concave surface substantially defined by the cylindrical portion of the first rotor and concentric about the first axis of rotation.

5. The dual rotation tablet mechanism of claim 4 further comprising:

the concave surface is bounded by a first edge and a second edge, both the first edge and the second edge extending from the first wall to the second wall, wherein the dual rotation tablet mechanism transforms from a use configuration to a storage configuration, in the use configuration the block portion of the first rotor is adjacent to the first edge and distant from the second edge, and in the storage configuration the block portion of the first rotor is distant from the first edge and adjacent to the second edge.

6. The dual rotation tablet mechanism of claim 1 further comprising:

the second width of the second rotor rotatable to a parallel configuration wherein the second width is parallel to the first axis of rotation, in the parallel configuration the second rotor acts inhibits rotation of the first rotor by acting upon the base.

7. A dual rotation tablet mechanism for securing a tablet arm to a furniture piece, the dual rotation tablet mechanism comprising:

a base securable to the furniture piece, the base having a first wall and a second wall, the first wall separated from the second wall by a first distance;

a first rotor rotationally secured to the base between the first wall and the second wall, the first rotor having a first axis of rotation;

a second rotor rotationally secured to the base and having a second axis of rotation substantially perpendicular to the first axis of rotation, the second rotor having a first width and a second width, the first width perpendicular to the second axis of rotation, the second width perpendicular to both the second axis of rotation and the first width, the first width being substantially equal to the first distance, and the second width being greater than the first distance; and the dual rotation tablet mechanism transforms from a use configuration to a storage configuration, wherein the use configuration the second rotor has a first flat surface adjacent to the first wall and a second flat surface adjacent to the second wall that prevent rotation of the second rotor about the second axis of rotation.

8. The dual rotation tablet mechanism of claim 7 wherein the second axis of rotation intersects the first axis of rotation.

9. The dual rotation tablet mechanism of claim 7 wherein the second rotor has a first convex surface distant from a second convex surface, each of the convex surfaces extending from the from the first flat surface to the second flat surface.

10. The dual rotation tablet mechanism of claim 7 wherein the base includes a first aperture and a second aperture both apertures located distant from the first axis of rotation, the first aperture and the second aperture define a clamping channel parallel to the first axis of rotation, the clamping channel adapted for clamping to the furniture piece.

11. The dual rotation tablet mechanism of claim 7 wherein one of the first rotor and the second rotor includes a semi-circular groove partially circumscribing the second axis of rotation, the other of the first rotor and the second rotor having a pin extending into the semi-circular groove and limiting the rotation of the second rotor about the second axis of rotation.

12. A tablet arm system for attachment to a furniture piece, the tablet arm system comprising:

a planar tablet, a dual axis rotation mechanism connecting to the planar tablet and adapted for attachment to the furniture piece, the dual axis rotation mechanism having a storage configuration and a use configuration wherein the planar tablet is horizontal above the dual axis rotation mechanism, the dual axis rotation mechanism having:

a base with a first side piece, a second side piece, and a connector piece rigidly secured to both the first side piece and the second side piece;

a first rotor block adjacent to and rotationally secured directly between the first side piece and the second side piece, the first rotor block having a first axis of rotation relative to the base;

a second rotor block distant from the first axis of rotation and rotationally secured to the first rotor block, the second rotor block having a second axis of rotation relative to the first rotor block and a first planar side parallel to a second planar side;

in the use configuration the first side piece extends away from the first axis of rotation beyond the first rotor to the second rotor block, a first side portion of the first side piece located directly adjacent to the first planar side, the second side piece extends from the first axis of rotation beyond the first rotor to the second rotor block, a second side portion of the second piece located directly adjacent to the second planar side, and the first side portion and the second side portion of the second piece rotationally lock the second rotor about the second axis of rotation.

13. The tablet arm system of claim 12 wherein in the storage configuration the planar tablet is vertically oriented, the first side portion is separated from the first planar side, and the second side portion is separated from the second planar side.

14. The tablet arm system of claim 13 wherein the dual axis rotation mechanism having an auxiliary configuration, in the auxiliary configuration the planar tablet is horizontally oriented above the dual axis rotation mechanism, the first side piece extends from the first axis of rotation past the first rotor to the second rotor block, the first side portion of the first side piece located directly adjacent to the second planar side, the second side piece extends from the first axis of rotation past the first rotor to the second rotor block, the second side portion of the second piece located directly adjacent to the first planar side, and the first side portion and the second side portion of the second piece rotationally lock the second rotor about the second axis of rotation.

15. The tablet arm system of claim 12 wherein the second rotor block has a first convex surface distant from a second convex surface, each of the convex surfaces extending from the from the first planar side to the second planar side.

16. The tablet arm system of claim 12 wherein the second rotor block has a second height along the second axis of rotation, and the planar tablet is separated from the first rotor block by the second height.

17. The tablet arm system of claim 12 wherein the second axis of rotation intersects the first axis of rotation.

18. The tablet arm system of claim 12 wherein the first side piece includes a first hole distant from the first axis of rotation, the second side piece includes a second hole distant from the first axis of rotation, and the first hole and the second hole define a clamping channel parallel to the first axis of rotation, the clamping channel adapted for clamping to the furniture piece.

19. The tablet arm system of claim 12 wherein the first side piece, the second side piece, and the connector piece are constructed from a single metal piece.

* * * * *